United States Patent [19]

Kohut et al.

[11] 4,022,974

[45] May 10, 1977

[54] ADAPTIVE LINEAR PREDICTION SPEECH SYNTHESIZER

[75] Inventors: Joseph Kohut, Basking Ridge; Joseph Philip Olive, Martinsville, both of N.J.

[73] Assignee: Bell Telephone Laboratories, Incorporated, Murray Hill, N.J.

[22] Filed: June 3, 1976

[21] Appl. No.: 692,425

[52] U.S. Cl. ..... 179/1.5 M

[51] Int. Cl.[2] ..... G10L 1/00

[58] Field of Search ..... 179/1.5 A, 1.5 M

[56] References Cited

UNITED STATES PATENTS

| | | | |
|---|---|---|---|
| 3,624,302 | 11/1971 | Atal | 179/1.5 A |
| 3,715,512 | 2/1973 | Kelly | 179/1.5 A |

OTHER PUBLICATIONS

Atal and Hanauer, "Speech Analysis and Synthesis," J of ASA, vol. 50, No. 2 (Part 2), 1971.

*Primary Examiner*—Kathleen H. Claffy
*Assistant Examiner*—E. S. Kemeny
*Attorney, Agent, or Firm*—J. S. Cubert

[57] ABSTRACT

A real-time predictive speech synthesizer produces an artificial speech signal from pitch period segmented codes. During the current pitch period both the current speech sound and the future (next) pitch period level-adjustment signal for the excitation generator are being formed. Each pitch period is subdivided into regularly spaced time periods and the intervals between the spaced time periods. Responsive to the predictive parameters of the currently occurring pitch period, preceding speech samples, and the adjusted excitation signal of the current pitch period, a prescribed set of current pitch period speech samples are generated in regularly spaced time periods. In the intervals between spaced time periods, prescribed components of the excitation level adjustment signal of the next successive pitch period are formed from the prediction parameters of the next successive pitch period, the preceding speech samples, and the next successive pitch period excitation signal. After the current pitch period final spaced time period, the formed components are combined with the next successive pitch period energy signal to produce the next successive pitch period excitation level adjustment signal.

26 Claims, 12 Drawing Figures

INPUT MODE

SAMPLE MODE

| FIG. 8A | FIG. 8B |
|---|---|

ADAPTIVE LINEAR PREDICTION SPEECH SYNTHESIZER

BACKGROUND OF THE INVENTION

Our invention relates to the artificial production of speech or other complex waves and, more particularly, to the synthesis of speech signals from parametric description codes representative of selected speech characteristics.

The production of good-quality synthetic speech is of interest in speech research, in communication systems where conservation of bandwidth is important, and in computer and related systems where voice output is desired. One known speech synthesis technique is based on the fact that an applied speech wave at any instance of time is a weighted sum of its past values whereby speech parameter signals can be developed which specify the linearly predictable characteristics of a speech signal. The parameter signals are utilized to control a discrete linear time-varying filter which is excited by a suitable combination of quasi-periodic pulses and white noise. The quasi-periodic pulses result in voiced excitation, while the white noise results in unvoiced excitation. An excitation adjustment amplifier is interposed between the excitation source and the filter, and the gain of the amplifier is controlled in accordance with the mean squared power of each segment of the speech signal to provide naturalsounding speech.

The speech signal comprises a sequence of pitch period segment speech samples. In any speech segment, the $n^{th}$ speech sample comprises a first component representative of the contribution of the memory of the prediction filter carried over from previous speech segments and a second component contributed by the excitation in the current speech segment. The gain of the excitation amplifier is adjusted to account for the presence of the overhang energy from the previous speech segment on the basis of the aforementioned first and second components and the mean squared value of the current speech segment. Thus, it is necessary to generate the excitation level adjustment factor of the current speech segment prior to the formation of the speech samples of the current speech segment. The information required for the generation of the overhang energy adjustment factor, however, includes the speech samples being formed in the current speech segment.

In vocoder-type systems utilizing linear predictive coding, coded signals representative of the predictive parameters of a pitch period of an applied speech signal, the pitch period of the speech signal, and the overhang energy adjustment factor (excitation level adjustment signal) are produced in a speech analyzer responsive to the applied speech signal. The coded signals are then transmitted to a speech synthesizer of the aforementioned type to control the generation of speech samples. The resulting speech samples are applied to a low-pass filter from which a replica of the applied speech signal is obtained. Such an arrangement is disclosed in U.S. Pat. No. 3,624,302, issued to B. S. Atal on Nov. 30, 1971.

While the overhang energy adjustment factor in the aforementioned Atal patent is produced prior to synthesis, it is often preferred to generate the overhang energy adjustment factor in the speech synthesizer. One arrangement in which this is done is shown in U.S. Pat. No. 3,715,512, issued to J. M. Kelly on Dec. 20, 1971. The Kelly arrangement requires that a frequency compressed auxiliary spectral envelope of an applied speech signal be generated via a linear predictive analyzer and synthesizer at a substantially reduced excitation rate to achieve economies in bandwidth. An overhang energy adjustment factor is included which is responsive to the RMS value of the pitch period speech signal, the prediction parameters of the pitch period, and a prescribed set of speech samples from the just-concluded pitch period to generate the excitation level (overhang energy) adjustment factor for use in the reduced rate synthesizer. Since the adjustment factor computer is operative at the real-time sampling rate while the speech synthesizer operates at a substantially lower rate, the adjustment factor can be readily computed and made available to provide the necessary gain modification of the synthesizer excitation amplifier. In reconstructing the speech signal from the frequency compressed auxiliary spectral envelope in a second speech synthesizer, however, the prediction parameters are available only at the substantially lower excitation rate whereby the overhang energy adjustment factor can only be modified at the lower rate. Since the adjustment factor cannot be modified at the pitch period excitation rate, the adjustment factor is incorrect for a substantial number of pitch periods and the resulting speech signal replica is not accurate.

In vocoder systems such as in aforementioned U.S. Pat. No. 3,624,302, the speech synthesizer is operative to resynthesize a speech signal after linear prediction analysis so that hangover energy adjustment may be readily formed in the vocoder speech analyzer. Where the speech synthesizer is operative at lower than real-time rates such as in aforementioned U.S. Pat. No. 3,715,512, it is relatively simple to compute the hangover energy adjustment factor prior to the formation of the low rate speech samples. In some linear prediction synthesizers operative at real-time pitch period rates, however, the hangover energy adjustment factor must be formed during synthesis. This is the case, for example, in synthesis by rule systems in which an artificial speech signal is produced responsive to stored phonetic descriptive codes. While it is theoretically possible to generate the hangover energy adjustment factor for a pitch period prior to the formation of the first speech sample of said pitch period, it is generally impractical to do so at real time pitch period rates because of the large number of processing steps required and the limited time available. It is an object of the invention to provide speech synthesis on the basis of segmented parametric description codes at pitch period rates in an economical manner.

SUMMARY OF THE INVENTION

The invention is directed to a predictive signal synthesis arrangement adapted to produce a speech signal from segmented parametric description codes in which speech samples are formed in regularly spaced time periods during each speech segment responsive to the prediction parameters of the speech segment, the level adjusted excitation signal of the speech segment, and preceding speech samples. In the intervals between said spaced time periods, component codes for the excitation level adjustment signal of the adjacent speech segment are cumulatively formed responsive to the adjacent speech segment prediction parameters, the adjacent speech segment excitation signal, and the preceding speech samples. upon termination of the final spaced time period of the speech segment, the excitation level adjustment signal of the adjacent speech segment is produced responsive to the accumulated component codes and the speech energy of the adjacent speech segment.

According to one aspect of the invention, the predictive codes are segmented into pitch periods of the speech signal to be synthesized.

According to another aspect of the invention, each pitch period is partitioned into a plurality of regularly spaced time periods so that speech samples are generated at a predetermined rate. In intervals between the spaced time periods, a plurality of excitation level adjustment factor components for the adjacent pitch period are cumulatively formed. Upon the termination of the final spaced time period of the partitioned pitch period, the excitation level adjustment signal for the adjacent pitch period is formed responsive to said accumulated components. In this manner, a relatively large shift in pitch period duration is accommodated.

According to yet another aspect of the invention, arithmetic apparatus is operative in each of said spaced time periods jointly responsive to the predictive parameters of the pitch period the pitch period adjusted excitation signal, and the prescribed set of preceding speech samples to form the next speech sample of the pitch period. In intervals between said spaced time periods, said arithmetic apparatus is operative jointly responsive to the predictive parameters of the adjacent pitch period, the adjacent pitch period excitation signal, and the prescribed set of preceding speech samples to cumulatively form a plurality of excitation level adjustment components. Upon termination of the final spaced time period, arithmetic apparatus is operative responsive to said accumulated component codes to generate the excitation level adjustment factor of the adjacent pitch period.

According to yet another aspect of the invention, first signals representative of the currently occurring pitch period predictive parameters, second signals representative of the next successive pitch period predictive parameters, and a third signal representative of the energy of the next successive pitch period speech signal are stored together with preceding speech samples, a coded excitation signal, and the excitation level adjustment signal of said current pitch period. Arithmetic means are operative during each spaced time period of the pitch period jointly responsive to said first signals, said preceding speech samples, said coded current pitch period excitation signal and said current pitch period excitation level adjustment factor signal to form a speech sample of said current pitch period. In selected intervals between said spaced time periods, said arithmetic means are operative jointly responsive to said second signals, the prescribed set of preceding speech samples and the coded next successive pitch period excitation signal to cumulatively form the excitation level adjustment factor components of the next successive pitch period. At the end of the final spaced time period of the pitch period, arithmetic means are operative to form the excitation level adjustment factor of the next successive pitch period responsive to said accumulated components and the energy of the speech signal of said next succesive pitch period.

According to yet another aspect of the invention, the number of current pitch period speech samples is stored and the number of speech samples generated in said current pitch period are counted. When the stored number equals the count, current pitch speech sample generation is terminated and the formation of the next successive pitch period excitation level adjustment signal is started.

According to yet another aspect of the invention, the numbers of speech samples of the next successive pitch period is stored and the number of component code formations is counted. Responsive to the comparison of the stored numbers and the count of component code formations, the component code formations are terminated. A plurality of component code formations occurs in each selected interval until said termination whereby a substantial range of pitch period durations is accommodated.

According to yet another aspect of the invention, a firsst memory stores the predictive parameters of one pitch period, a second memory stores the predictive parameters of the next succeeding pitch period, and a third memory stores the energy value of the next succeeding pitch period speech signal. A fourth memory stores the preceding speech samples, a fifth memory stores the formed excitation level adjustment factor code of said one pitch period, and a sixth memory stores the excitation signals of said one and next succeeding pitch periods. During each spaced time period of said one pitch period, the pitch period predictive parameters from the first memory, the prescribed set of preceding speech samples from the fourth memory, the excitation level adjustment factor of said one pitch period from the fifth memory and the excitation signal of said one pitch period from said sixth memory are applied to a first arithmetic circuit which is operative responsive thereto to form the never speech sample of said one pitch period. In intervals between said spaced time periods, the arithmetic circuit is operative responsive to the next succeeding pitch period predictive parameters from said second memory, the preceding speech samples from said fourth memory, and the next succeeding pitch period excitation signal from said sixth memory to cumulatively generate a prescribed set of excitation level adjustment component codes. Upon termination of the final spaced time period of said one pitch period, a second arithmetic circuit is operative to form the excitation level adjustment factor code of the next succeeding pitch period responsive to the next succeeding pitch period speech energy value from said third memory and the accumulated adjustment component codes. In this manner, the sequence of speech samples of the speech signal are formed in real time.

DETAILED DESCRIPTION

Figure 1:
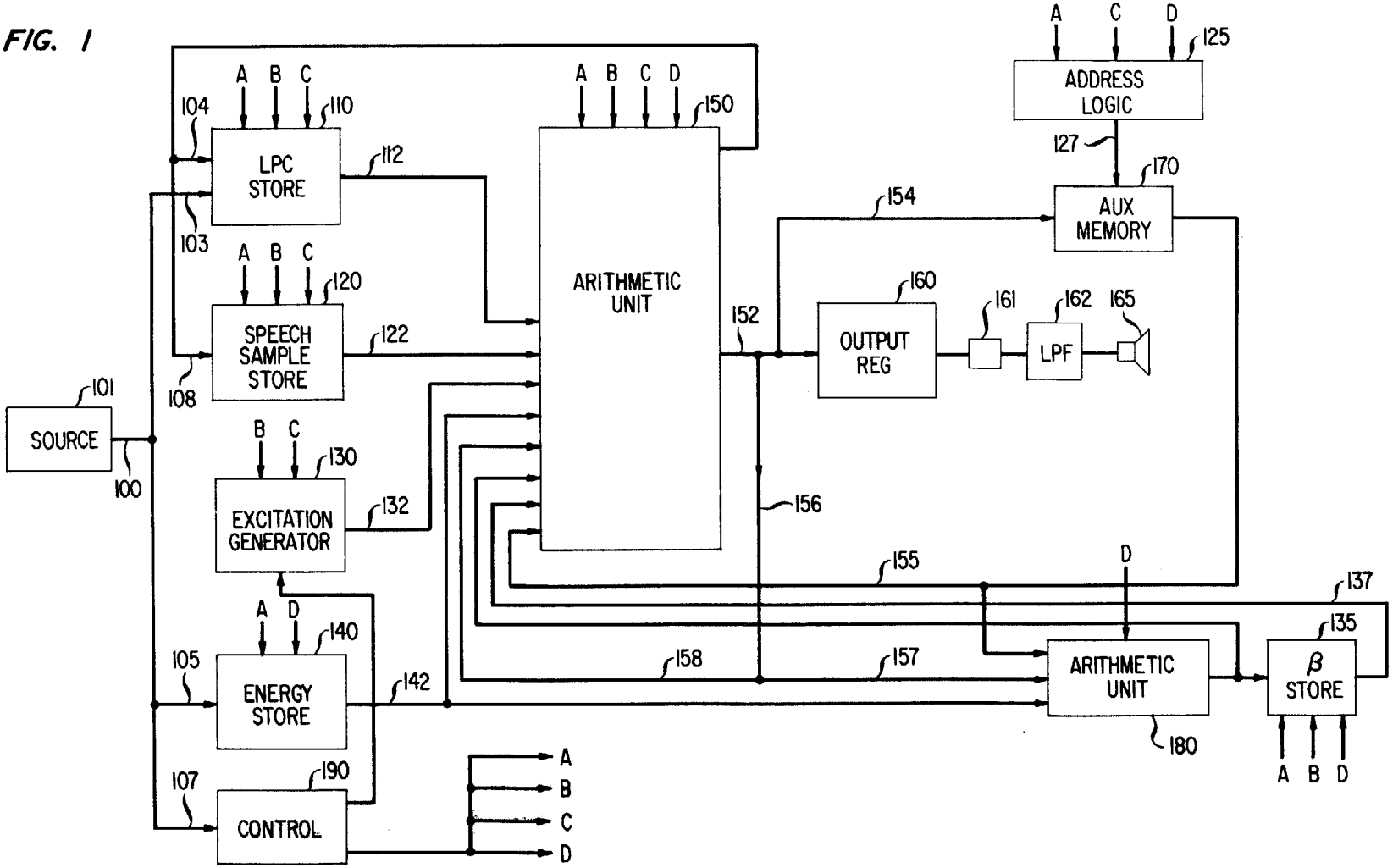
FIG. 1 depicts a general block diagram of a speech synthesizer illustrative of the invention.

In accordance with the well-known principles of linear prediction synthesis, a speech signal may be formed in a linear prediction filter driven by a pulse excitation source and controlled by a prescribed set of linear prediction parameters. The speech signal can be accurately represented by a sequence of speech samples, $s_n$. Each speech sample, $s_n$, is formed on the basis of preceding samples modified by linear prediction coefficients, $a_i$, and an excitation signal $E_n$ as set forth in Equation (1):

$$s_n = \beta E_n + \sum_{i=1}^{p} a_i s_{n-i}, \quad (1)$$

where $\beta$ is an excitation level adjustment factor inserted to account for overhang energy remaining in the predictive filter as a result of previous excitation and $p$ is the order of the predictive filter which may typically be 12.

Each speech sample, $s_n$, in a pitch period segment of $m$ regularly occurring speech samples can be represented as:

$$s_n = \beta D_n + R_n \quad 1 \leq n \leq m,$$

where $D_n$ is the component of speech sample $s_n$ resulting from excitation in the current pitch period and $R_n$ is the current component of speech sample $s_n$ resulting from excitation in previous pitch periods. $D_n$ and $R_n$ are formed in accordance with Equations (3a) and (3b):

$$D_n = \sum_{i=1}^{p} a_i D_{n-i} + E_n, \quad (3a)$$

$$R_n = \sum_{i=1}^{p} a_i R_{n-i}, \quad (3b)$$

$R_0, R_{-1}, \ldots, R_{1-p}$ are formed in accordance with $R_0 = R_m + \beta D_m, \ldots, R_{1-p} = R_{m+1-p} + \beta D_{m+1-p}$ to provide the input parameters for the first p components of the pitch period, where $m$ represents the last sample of the preceding pitch perios. $D_0, \ldots, D_{1-p}$ are all zero valued.

The mean squared value of the speech signal of a pitch period of $m$ samples is:

$$P_s = \sum_{n=1}^{m} s_n^2 = \sum_{n=1}^{m} (\beta D_n + R_n)^2 \quad 1 \leq n \leq m. \quad (4)$$

From Equation (4), the appropriate excitation level or overhang energy adjustment factor $\beta$ can be determined as:

$$\beta = \frac{-\sum_{n=1}^{m} R_n D_n + \sqrt{\left(\sum_{n=1}^{m} R_n D_n\right)^2 - \sum_{n=1}^{m} D_n^2 \left(\sum_{n=1}^{m} R_n^2 - P_s\right)}}{\sum_{n=1}^{m} D_n^2}. \quad (5)$$

It is therefore necessary to produce the excitation level adjustment factor $\beta$ for a particular pitch period in accordance with Equation (5) prior to the generation of the speech samples of that pitcch period by means of Equation (1). In the speech synthesizer of FIG. 1, the speech samples of a current pitch period, e.g., pitch period L, are generated at a predetermined rate, e.g., 10 kKz. In intervals intermediate the speech sample generation periods, the set of overhang energy adjustment factor components of the next succeeding pitch period, pitch period L+1, are produced. At the end of the last speech sample generation interval of pitch period L, the circuit of FIG. 1 is operative to form the overhang adjustment factor of pitch period L+1, $\beta_{L+1}$. In this way, $\beta_{L+1}$ is available in real time for speech sample generation at the predetermined rate without interruption. Since the number of samples in pitch period L+1 may be much greater than the number of samples in pitch period L and all $m$ samples of pitch period L+1 enter into the generation of $\beta_{L+1}$ of Equation (5), a plurality of sets of $\beta L_{+1}$ factor components are cumulatively generated in selected intervals between speech sample generation intervals. In this manner, a large range of pitch period durations are accommodated. For example, if pitch period L includes 50 speech samples and 8 sets of $\beta_{L+1}$ component factors are formed in each selected interval, pitch period L+1 may include 392 speech samples. In general, a 7 to 1 range of pitch periods can be readily accommodated. Where there are fewer than 392 samples in pitch period $L_+1$, the formation of $\beta_{L+1}$ component factors is terminated prior to the last time period of pitch period L.

The speech synthesizer of FIG. 1 is responsive to stored pitch period segmented parametric description codes to produce a prescribed speech signal. The parametric description codes for each pitch period include a first group of coded signals representative of the pitch period prediction parameters $a_i$, a second coded signal representative of the duration (number of samples $m_L$) of the pitch period, a third coded signal representative of the energy (mean squared value) $P_s$ of the pitch period speech signal, and a fourth coded signal representative of the excitation signal E of the pitch period. These coded signals are formed and stored in signal source 101 which may comprise a digital computing device such as The Control Computer Corp. DDP 224 computer.

In FIG. 1, prediction parameter store 110 is adapted to store the linear prediction coefficients $a_i$ of the current and next successive pitch periods. Speech sample store 120 is operative to store prescribed sets of preceding speech samples $s_n$ and speech sample components $R_n$ and $D_n$; and store 140 is adapted to store the next successivve pitch period mean squared value $P_s$. Store 135 operates to store the last generated excitation level adjustment factor $\beta_L$. Auxiliary memory 170 is adapted to store component codes of Equation (5) necessary for the generation of $\beta_{L+1}$ and formed through the operation of arithmetic circuit 150. Arithmetic circuit 180 is used in the generation of overhang adjustment factor $\beta_{L+1}$ from the component codes previously accumulated in auxiliary memory 170.

The operation of the speech synthesizer of FIG. 1 is controlled by control 190 which is responsive to signals received from source 101 and to the operation of the circuit of FIG. 1 to produce timing control signals A, B, C, and D. These control signals are representative of the time periods or modes in which components of FIG. 1 are operative and these control signals are distributed to the stores and arithmetic circuits of FIG. 1 as shown therein.

Figure 2:
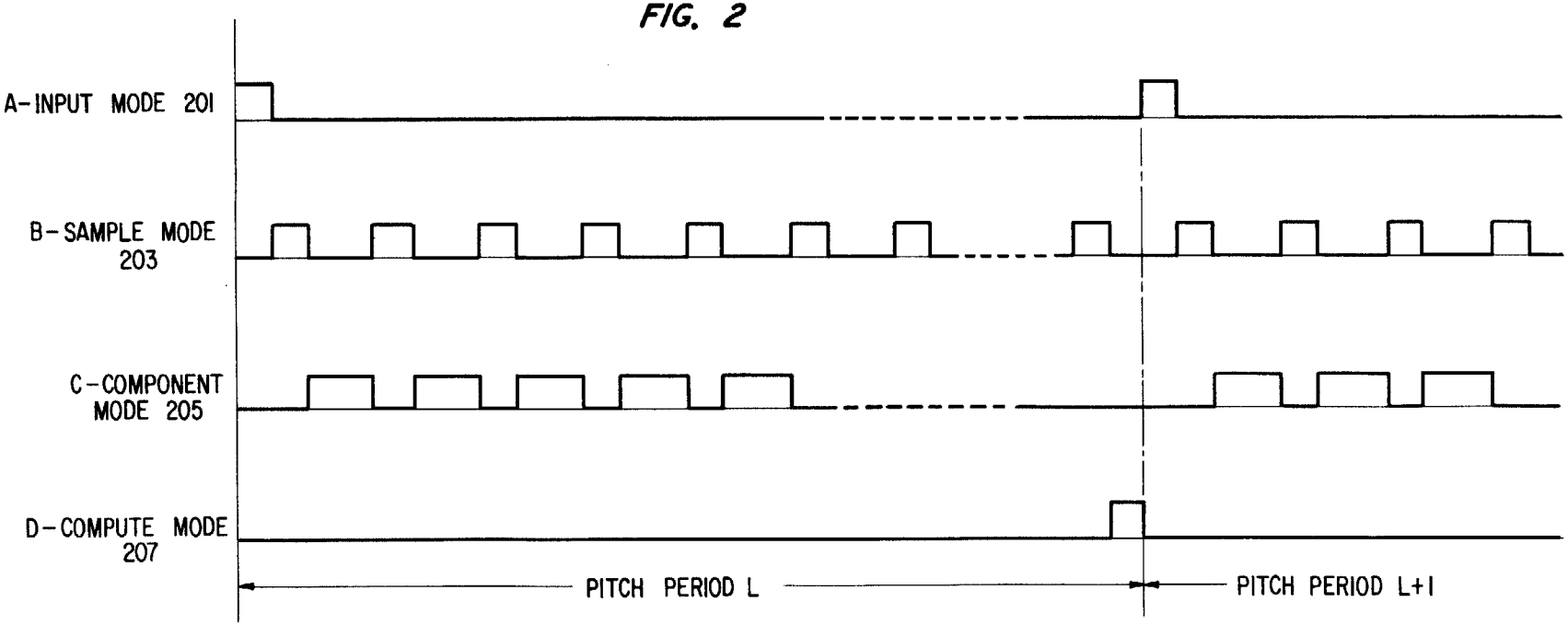
FIG. 2 shows timing waveforms useful in describing the operation of the synthesizer of FIG. 1.

FIG. 2 shows waveforms which illustrate the sequence of operations used in the circuit of FIG. 1. LWaveform 201, corresponding to control signal A, occurs at the beginning of each pitch period and is effective to place the circuit of FIG. 1 in its input mode. During the input mode, pitch period duration, energy and coefficient codes stored in signal source 101 are transferred to the speech synthesizer and initial signals $R_n$ used in the formation of $\beta$ component codes of pitch period L+1 are formed and stored.

Waveform 203, corresponding to signal B, occurs during predetermined spaced time periods of the pitch period and is effective to place the circuit of FIG. 1 into its speech sample generation mode during which speech samples $s_n$ of pitch period L are successively formed at a predetermined rate. Waveform 205, corresponding to signal C, occurs between selected signal B time periods to place the circuit of FIG. 1 in its overhang energy ($\beta$) component mode in which a plurality of prescribed sets of component codes of Equation (5) are formed and cumulatively stored in auxiliary memory 170. Waveform 207 corresponds to signal D and is effective after the last occurrence of signal B in pitch period L to place the circuit of FIG. 1 in its overhang energy adjustment factor $\beta_{L+1}$ generation mode during which the $\beta_{L+1}$ factor for the next successive pitch period is formed responsive to the stored codes in auxiliary memory 170 and $P_s$ from store 140.

At the beginning of each pitch period, e.g., pitch period L shown in FIG. 2, LPC store 110 contains the linear prediction coefficient $a_1, \ldots, a_{12}$ of pitch period L-1 and the linear prediction coefficient $a_1, \ldots, a_{12}$ of pitch period L. Speech sample store 120 contains the last 12 speech samples $s_m, s_{m-1}, \ldots, s_{m-11}$ of pitch period L-1, the last 12 $R_m$ components $R_m, R_{m-1}, \ldots, R_{m-11}$, and the last 12 $D_m$ components $D_m, D_{m-1}, \ldots, D_{m-11}$ of pitch period L. Store 135 contains the excitation level adjustment factor $\beta_L$ of pitch period L which was formed at the end of pitch period L-1 and store 140 contains the means squared value $-P_S$ of the speech samples of pitch period L.

During pitch period L, the speech samples $s_1, s_2, \ldots, s_m$ of pitch period L are generated at the predetermined rate of 10 kHz and $\beta_{L+1}$ of pitch period L+1 is formed. In the input mode of pitch period L, the initial $R_0, R_{-1}, \ldots, R_{118\ 11}$ components of pitch period L+1 are generated from the $R_m, \ldots, R_{m-11}$ codes and the $D_m, \ldots, D_{m-11}$ codes stored in speech sample store 120. The linear prediction coefficients of pitch period L+1 replace the linear prediction coefficients of pitch period L-1 in store 110, and $-P_S$ of pitch period L+1 replaced $P_s$ of pitch period L in store 140. The prediction coefficients of pitch period L remain in store 110. Additionally, a coded signal corresponding to the duration (number of samples $m_{L+1}$) of pitch period L+1 is inserted in control 190. This pitch period code also contains the excitation character (voiced or unvoiced) of the pitch period.

Responsive to signal A (waveform 201), the circuit of FIG. 1 is placed in the first cycle of the input mode, during which the L+1 pitch period duration code ($m_{L+a}$) is transferred from source 101 via lines 100 and 107 to control 190 so that the pitch period duration codes of pitch periods L and L+1 are stored. The pitch period duration codes are representative of the number of samples of the pitch period. Where a pitch period is unvoiced a special duration code is transferred from source 101 to control 190 which sets the pitch period to a selected number of samples. In the next cycle of the input mode, the $-P_S$ code representative of the mean squared value of the speech signal segment of pitch period L+1 is transferred from source 101 via lines 100 and 105 to store 140 wherein it is stored for use in the computation of $\beta_{L+1}$.

In the third cycle of the input mode, the $R_{m-11}$ code from store 120 is applied via line 122 to arithmetic circuit 150 where it is temporarily stored. $D_{m-11}$ is then transferred from store 120 via line 122 to arithmetic circuit 150 and $\beta_L$ is applied to arithmetic circuit 150 from store 135 via line 137. In arithmetic circuit 150, the code $$R_{-11} = R_{m-11} + \beta_L D_{m-11} \qquad 6$$

is formed and applied to store 120 via line 108 to replace the $R_{m-11}$ code therein. Linear prediction code $a_1$ of pitch period L+1 is then applied from source 101 via line 100 to store 110 wherein it is stored. The $a_1$ code of pitch period L−1 is removed. This process is continued for 11 more cycles until $$R_0 = R_m + \beta_L D_m, \ldots, R_{-11} = R_{m-11} + \beta_L D_{m-11} \qquad 7$$

replace $R_m, \ldots, R_{m-11}$ in store 120. During the last 12 cycles of the input mode, the D portion of store 120 is cleared; $a_1, \ldots, a_{12}$ of pitch period L−1 are deleted; and $a_1, \ldots, a_{12}$ of pitch period L+1 are put into store 110. During the 14 cycles of the input mode, auxiliary memory 170 is also cleared under control of address logic 125 via line 127. Responsive to the next speech sample mode initiating signal after the input mode 14th cycle, the state of control 190 is advanced to the speech sample generation mode.

Control 190 now supplies signal B (waveform 203 of FIG. 2), and the circuit of FIG. 1 is operative to form speech sample $s_1$ in accordance with Equation (1). This is done on the basis of the set of previous speech samples $s_m, \ldots, S_{m-11}$ of pitch period L−1 in store 120, the linear prediction coefficients $a_1, \ldots, a_{12}$ of pitch period L in store 110, $\beta_L$ in store 135, and the excitation signal $E_n$ of pitch period L obtained from excitation generator 130. During the first time slot of the speech sample mode, linear prediction coefficient $a_{12}$ of pitch period L from store 110 is applied to arithmetic circuit 150 via line 112, and speech sample $s_{m-11}$ is applied from store 120 to arithmetic circuit 150 via line 122. The product $a_{12}s_{m-11}$ is formed and temporarily stored in arithmetic circuit 150. In the succeeding 11 cycles of the speech sample mode, the products $a_{12}s_{m-11}, \ldots, a_1 s_m$ are successively formed and accumulated in arithmetic circuit 150 to provide a coded signal corresponding to $$\sum_{i=1}^{P} a_i s_{1-i} \qquad (8)$$

where $m$ is set to zero. This result is temporarily stored in arithmetic circuit 150 and the product $\beta_L E_1$ is generated in arithmetic circuit 150 responsive to the $\beta_L$ code from store 135 and the excitation signal code $E_1$ in generator 130. The $\beta_L E_1$ code is added to the temporarily stored result to form $$s_1 = \beta_L E_1 + \sum_{i=1}^{P} a_i s_{1-} \qquad (9)$$

$s_1$ is then transferred from arithmetic circuit 150 via output register 160 to a utilization device which may comprise digital-to-analog converter 161, low-pass filer 162 and speech reproducer 165. $s_1, s_m, \ldots, s_{m-10}$ are also put into store 120 to replace $s_m, \ldots, s_{m-11}$. After speech sample $s_1$ is generated, the state of control 190 is changed to place the circuit of FIG. 1 in its $\beta L_+1$ component mode.

In the component mode, control 190 supplies timing signal C (waveform 205 of FIG. 2) and the circuit of FIG. 1 is made operative to partially form the three component codes of the overhang energy adjustment factor $\beta_{L+1}$ of Equation (5).

$$\sum_{n=1}^{n} (D_n^2) = -\sum_{n=1}^{n} \left[\sum_{i=1}^{12} a_i D_{n-i} + E_n\right]^2 \quad (10a)$$

$$\sum_{n=1}^{n} (R_n^2) = \sum_{n=1}^{n} \left[\sum_{i=1}^{12} a_i R_{n-i}\right]^2 \quad (10b)$$

$$\sum_{n=1}^{n} D_n R_n, \quad (10c)$$

where $n$ is less than or equal to $m_{L+1}$, the number of samples in pitch period $L_+1$. Each $\beta$ component mode consists of a plurality of repetitive portions. During each portion, each of the component codes of Equations (10a) through (10c) is formed and summed with the corresponding component code previously stored in auxiliary memory 170. At the beginning of the $n^{th}$ $\beta_{L+1}$ component portion, store 120 contains the values $R_n^-{}_1, \ldots, R_n^-{}_{12}$ and $D_n^-{}_1, \ldots, D_n^-{}_{12}$ obtained in the preceding $\beta_{L+1}$ component mode portion. Responsive to signal C from control 190, excitation signal E of pitch period L+1 is applied from generator 130 to arithmetic circuit 150 wherein it is temporarily stored. The linear prediction coefficients $a_1, \ldots, a_{12}$ of pitch period L+1 are then sequentially read out of store 110 and the previously stored $D_{n-1}, \ldots, D_{n-12}$ codes are sequentially read out of store 120. The $a_i$ and $D_{n-i}$ signals are applied to arithmetic circuit 150 wherein the coded signal $$D_n = \sum_{i=1}^{12} a_i D_{n-i} + E_n \quad (11)$$

is formed by successive multiplication and addition. This $D_n$ code is placed in a predetermined location of auxiliary memory 170 via line 154 as addressed by address logic 125 and is also returned to store 120 so that $D_n, \ldots, D_{n-11}$ replaces $D_{n-1}, \ldots, D_{n-12}$ in store 120. $D_n$ is multiplied by itself and added to $$\sum_{n=1}^{n-1} (D_n)^2$$

obtained from a second location of auxiliary memory 170 as addressed by address logic 125 to form $$\sum_{n=1}^{n} (D_n)^2$$

which is then returned to said second location.

In the next cycle of the $n^{th}$ portion, arithmetic circuit 150 is operative to perform successive multiplications and accumulative additions so that $R_n$ is formed in accordance with $$\sum_{i=1}^{12} a_i R_{n-}$$

from the sequence of linear prediction coefficients $a_1, \ldots, a_{12}$ of pitch period L+1 obtained from store 110 and the sequence $R_{n-1}, \ldots, R_{n-12}$ obtained from store 120. The resultant code $R_n$ is placed in a third location of auxiliary memory 170 and also returned to store 120. $R_{n-1}, \ldots, R_{n-12}$ in store 120 is thereby replaced by $R_n, \ldots, R_{n-11}$. The just obtained value for $R_n$ is then multiplied by itself and added to the previously obtained sum $$\sum_{n=1}^{n-1} (R_n)^2$$

from auxiliary memory 170 via line 155. The resultant $$\sum_{n=1}^{n} (R_n)^2$$

is then returned to auxiliary memory 170 via line 154. In the last period of the $R_n$ cycle, the coded signals $D_n$ and $R_n$ are multiplied in arithmetic circuit 150 and the resultant product is added to $$\sum_{n=1}^{n-1} D_n R_n$$

from auxiliary memory 170. The partial sum $$\sum_{n=1}^{n} D_n R_n$$

is then returned to auxiliary memory 170.

After the eighth repetitive portion of the $\beta$ component mode, responsive to the next occurrence of a speech generation initiating signal after the return of component code $$\sum_{n=1}^{n} D_n R_n$$

to auxiliary memory 170, the state of control 190 is changed so that the circuit of FIG. 1 is placed in the sample generation mode.

As aforementioned, a new speech sample is formed in each sample generation mode at a predetermined rate. The number of samples formed during each pitch period is determined by the pitch duration code of pitch period L stored in control 190, and the number of $\beta_{L+1}$ component modes is determined by the pitch period duration code of pitch period L+1 also stored in control 190. There may be fewer $\beta_{L+1}$ component modes than sample generate modes during a particular pitch period L. Consequently, after the last $\beta_{L+1}$ component mode signaled responsive to L+1 pitch period duration code, several sample generation modes can occur at the predetermined rate but no additional $\beta_{L+1}$ component modes are enabled. After the last sample generate mode, the state of control 190 is changed responsive to the stored pitch period duration code of pitch period L, so that signal D shown in waveform 207 of FIG. 2 is generated and the circuit of FIG. 1 is placed in the $\beta_{L+1}$ compute mode.

In the beginning of the $\beta_{L+1}$ compute mode, auxiliary memory 170 contains the component codes of Equations (10*a*) through (10*c*) accumulated for the $m_{L+1}$ samples of pitch period L+1. These component codes and the $-P_S$ code in store 140 are combined in arithmetic circuits 150 and 180 to form the overhang energy adjustment factor $\beta_{L+1}$ in accordance with Equation (5). In the first portion of the $\beta$ compute mode, the component code $$\sum_{n=1}^{m_L+1} (R_n)^2,$$

(where $m_{L+1}$ represents the number of samples in pitch period L+1) is read out of auxiliary memory 170 and applied to arithmetic circuit 150 as is the $-P_S$ code from store 140. Responsive to these codes, the code $$Q = \sum_{N=1}^{m_L+1} (R_n)^2 - P_S$$

is formed in arithmetic circuit 150 and returned to auxiliary memory 170. The sign of Q is also stored in arithmetic unit 180. Where the sign of Q is positive, a zero code is inserted in store 135 for use as $\beta_{L+1}$. A positive value for Q corresponds to the condition where the component of the speech samples of pitch period L+1 resulting from excitation in pitch periods prior to pitch period L+1 exceeds the energy of the speech signal in pitch period L+1. This may occur if there is a sudden reduction in speech level. In such an event, the previous excitation component is too large and the use of an excitation level adjustment factor derived therefrom results in inaccurate speech samples for pitch period L+1. It has been found that setting the excitation level adjustment factor to zero for those pitch periods when Q is positive improves the accuracy of the speech signal.

In the second portion of the $\beta$ compute mode, the Q code is applied from auxiliary memory 170 to arithmetic circuit 150 where it is temporarily stored.

$$SD = \sum_{n=1}^{m_L+1} D_n^2$$

is also applied from auxiliary memory 170 to arithmetic circuit 150, which is operative to form the product SD Q. This product is temporarily stored in arithmetic circuit 150. The component code $$SC = \sum_{N=1}^{m_L+1} D_n \cdot R_n$$

is then obtained from auxiliary memory 170 and applied to arithmetic circuit 150 wherein it is multiplied by itself to form $$(SC)^2 = \left( \sum_{n=1}^{m_{L+1}} D_n \cdot R_n \right)^2$$

The code corresponding to $(SC)^2$ - SD . Q is then formed in arithmetic circuit 150 and this code is applied to arithmetic circuit 180 wherein the square root code $\sqrt{SC^2 - SD \cdot Q}$ is generated. The result of the square root operation in arithmetic unit 180 is then returned to arithmetic circuit 150 and added to $-SC$ to form $$-SC + \sqrt{(SC)^2 - SD \cdot Q}.$$

During the final portion of the $\beta_{L+1}$ compute mode, the component code SC is applied to arithmetic circuit 180 from auxiliary memory 170. The code $$-SC + \sqrt{(SC)^2 - SD \cdot Q}$$

is also applied to arithmetic unit 180 from arithmetic circuit 150. Arithmetic circuit 180 is operative to form $$\beta_{L+1} = \frac{-SC + \sqrt{(SC)^2 - SD \cdot Q}}{SD}$$

corresponding to Equation (5). The result of this operation is the $\beta_{L+1}$ code which is applied to store 135 for use in the speech generation operations of pitch period L+1. The termination of $\beta_{L+1}$ compute mode is signaled by the completion of the division operation in arithmetic unit 180. Responsive to termination of the $\beta L_{+}1$ compute mode of pitch period L, the circuit of FIG. 1 is placed in the input mode of the next occurring pitch period (L+1) as shown in FIG. 2.

In accordance with the invention, the speech samples of pitch period L are successively generated at a predetermined rate from pitch period segmented description codes and preceding speech samples. Between speech sample generation mode periods, components codes needed to produce the excitation level adjustment signal of adjacent pitch period L+1 are cumulatively formed. Since the number of samples in pitch period L+1 may greatly exceed the number of samples in pitch period L, a plurality of cumulative component codes are formed in between successive speech sample generation periods. After the last speech sample generation period of the pitch period is terminated, the accumulated component codes and the pitch period L+1 energy value code are utilized to produce the excitation level adjustment signal ($\beta_{L+1}$) of pitch period L+1. $\beta_{L+1}$ is then stored for use in the formation of speech samples in the next successive pitch period L+1.

Figure 3:
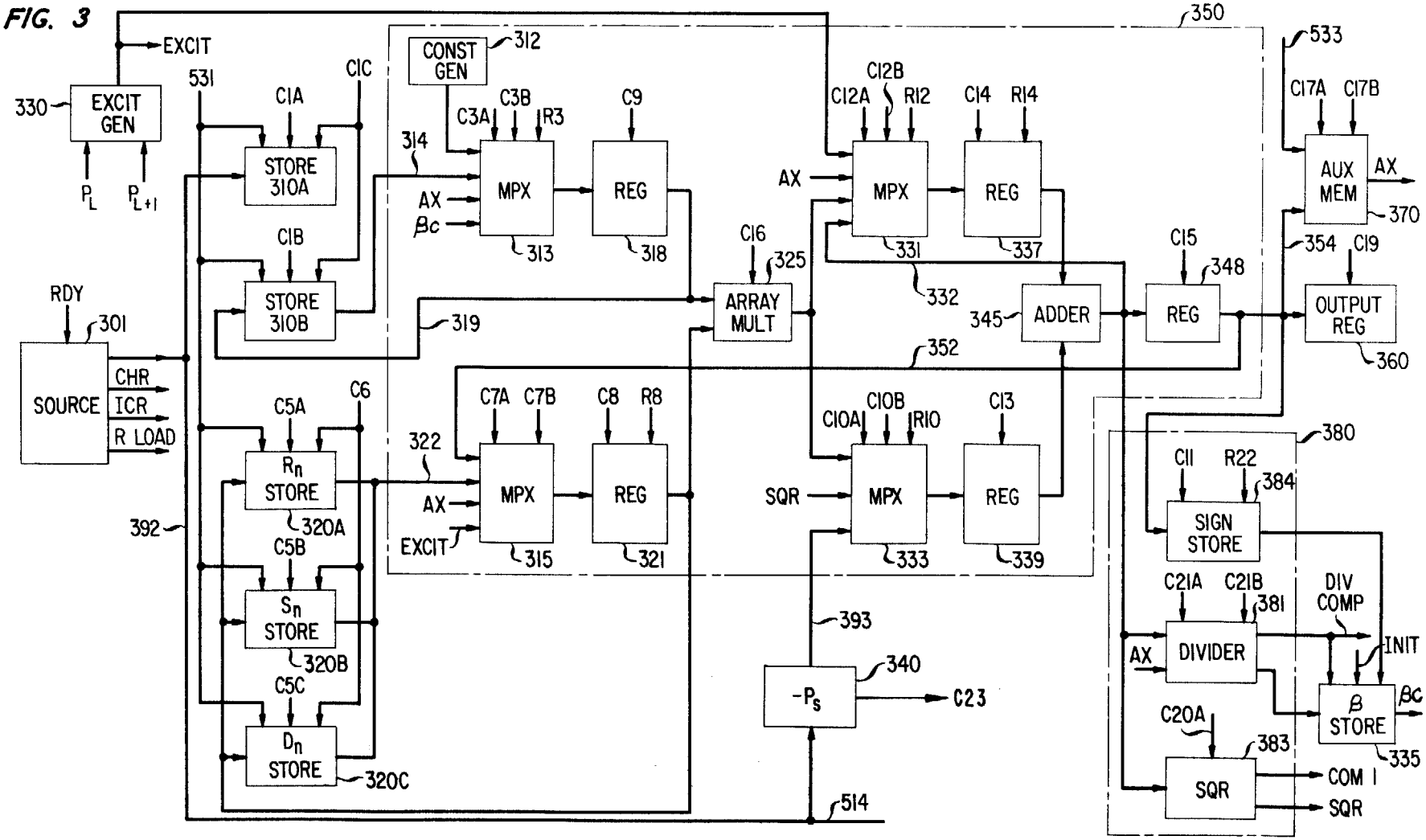
FIGS. 3, 4A, 4B and 5 depict a detailed block diagram of the speech synthesizer illustrative of the invention.

FIGS. 3, 4A, 4B, and 5 show a detailed block diagram of the speech synthesizer of FIG. 1. Referring to FIG. 3, store 310B is used to store the linear prediction coefficients $a_1, \ldots, a_{12}$ of the currently occurring pitch period, e.g., pitch period L. These coefficients are used in the speech sample generation modes of the current pitch period L. Store 310A is operative to store the linear prediction coefficients $a_1, \ldots, a_{12}$ of the next successive pitch period, (pitch period L+1) which are used in the component modes of the currently occurring pitch period to form the $\beta_{L+1}$ component codes. Stores 320A, 320B, and 320C are operative to store the most recent $R_n$, $s_n$, and $D_n$ codes, respectively. The $R_n$ and $D_n$ codes are used in the component modes of the current pitch period to generate the component codes of the excitation level adjustment signal ($\beta_{L+1}$) of the next successive pitch period. The $s_n$ codes of store 320B are used in the speech sample generation modes of the current pitch period. Store 340 is used to store the $-P_S$ code representative of the mean squared value of the speech signal in the L+1 pitch period.

Excitation generator 330 is operative to produce excitation pulses for use in the speech sample and $\beta_{L+1}$ component modes of the currently occurring pitch period. During the speech sample mode, excitation generator 330 produces the excitation signal corresponding to pitch period L. During component modes, generator 330 produces the excitation signals of pitch period $L_+1$. Where the speech signal of a pitch period is voiced, generator 330 produces a single pulse code corresponding to voiced excitation, and where there is an unvoiced pitch period, generator 330 is operative to produce a sequence of random pulse codes.

Register 318 of arithmetic circuit 350 provides a temporary store for input codes received from stores 310A or 310B, or other sources. The input connection to register 318 is controlled by multiplexer 313, which is operative to provide a selective transfer path into register 318 from the various sources connected thereto. Register 321 provides a temporary store for input codes from stores 320A, 320B or 320C, or other sources. The source connected to register 321 is controlled by multiplexer 315, which is operative to transfer codes from a selected source into register 321. The outputs of registers 318 and 321 are connected to the inputs of multiplier 325. This multiplier is used to perform the multiplication operations indicated in Equations (1) through (5). Multiplier 325 may comprise an array multiplier of the type described in chapter 8 of "Theory and Application of Digital Signal Processing" by Lawrence R. Rabiner and Bernard Gold, Prentice Hall, 1975, and includes its own input registers.

The output of multiplier 325 is applied to multiplexers 331 and 333 for selective transfer of said output products to registers 337 and 339. Registers 337 and 339 provide temporary stores for the outputs of multiplier 325 and other devices preparatory to summing operations in adder 345. The input to register 337 is controlled by multiplexer 331, and the input to register 339 is controlled by multiplexes 333. Registers 337 and 339 constitute the input registers to adder 335, which may be a parallel adder of the type described in chapter 15 of "The Logic of Computer Arithmetic" by Ivan Flores, Prentice Hall, Inc., 1963. The output of adder 345 is applied to multiplexer 331, register 348 and other devices as shown in FIG. 3. Register 348 operates as a buffer register to temporarily store the speech sample outputs from adder 345 prior to transfer to output register 360.

Auxiliary memory 370 is an addressable temporary memory operative to store the component codes needed to generate $\beta_{L+1}$. Memory 370 is addressed during the $\beta$ component mode to temporarily store the accumulated component codes of Equations (10*a*)-(10*c*) and is further addressed during the $\beta$ compute mode to provide inputs and temporary storage needed in the formation of $\beta_{L+1}$. Arithmetic circuit 380 comprises square root device 383, divider 381, and sign store 384. Square root device 383, sign store 384, and divider 381 are used during the $\beta$ compute mode to combine the component codes from auxiliary memory 370 and arithmetic circuit 350 whereby the $\beta_{L+1}$ code is formed for use in speech sample generation during pitch period L+1.

The registers, multiplexers, and other circuits shown in FIGS. 3, 4A, 4B, and 5 may comprise integrated circuits well known in the art. The 74000 series circuits or other types well known in the art may be used. Registers 318, 321, 337 and 339 may utilize integrated circuit types 74S174 or 74S175 and multiplexers 313, 315, 331, and 333 can be of the 74S157 type. The other logic circuits may also comprise integrated circuits of the 74000 series types.

Figure 4A:
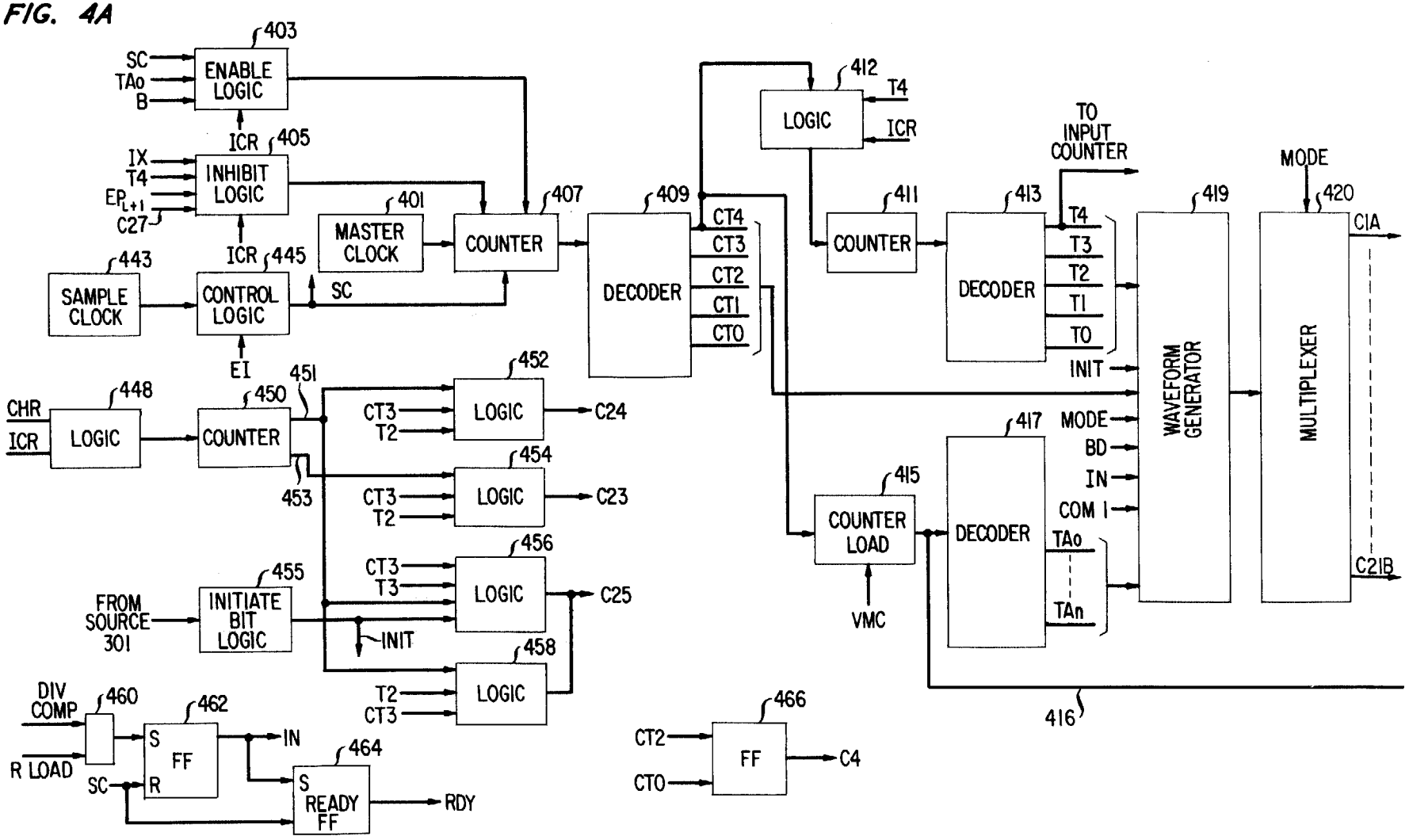
Figure 4B:
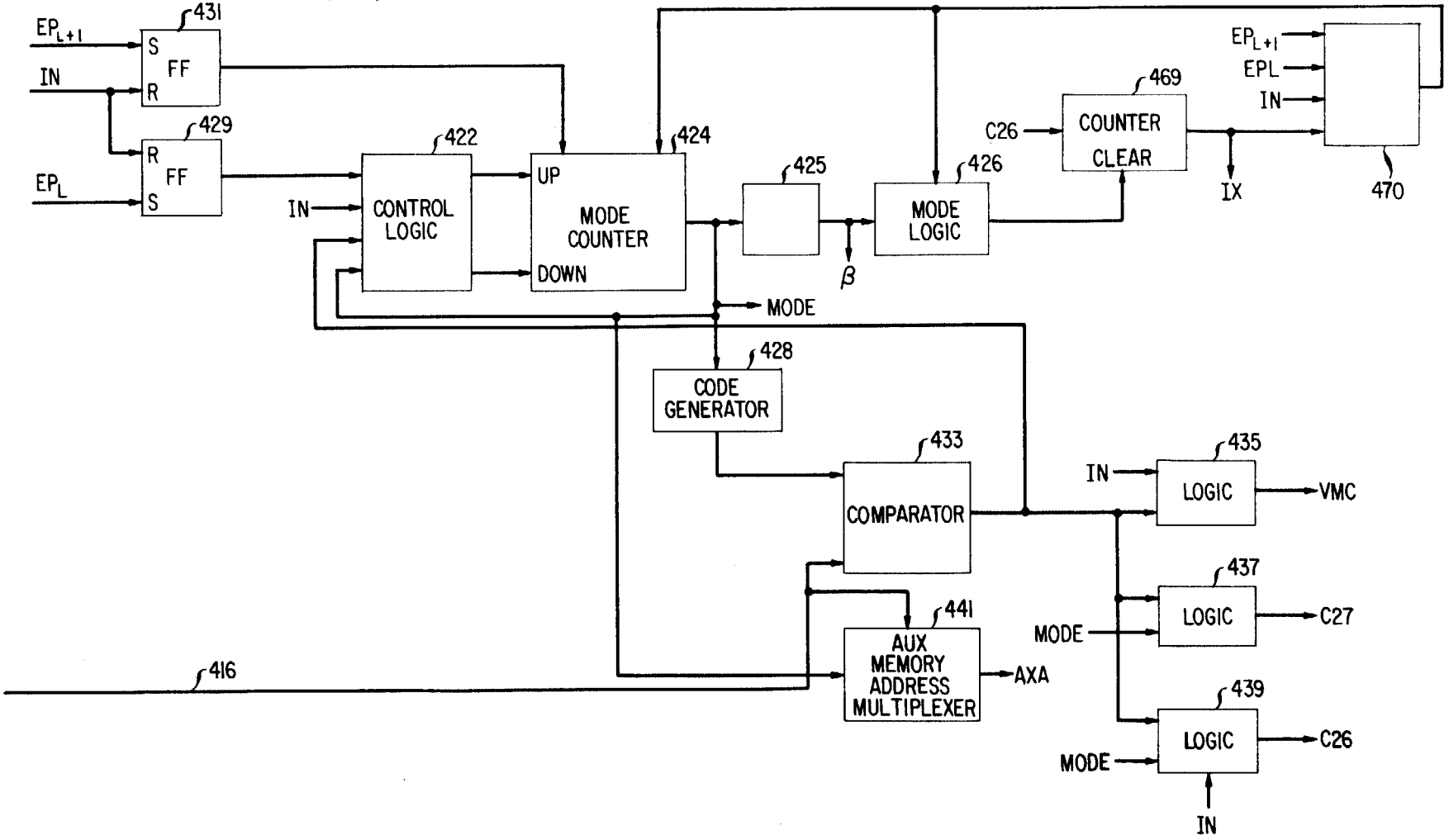
Figure 5:
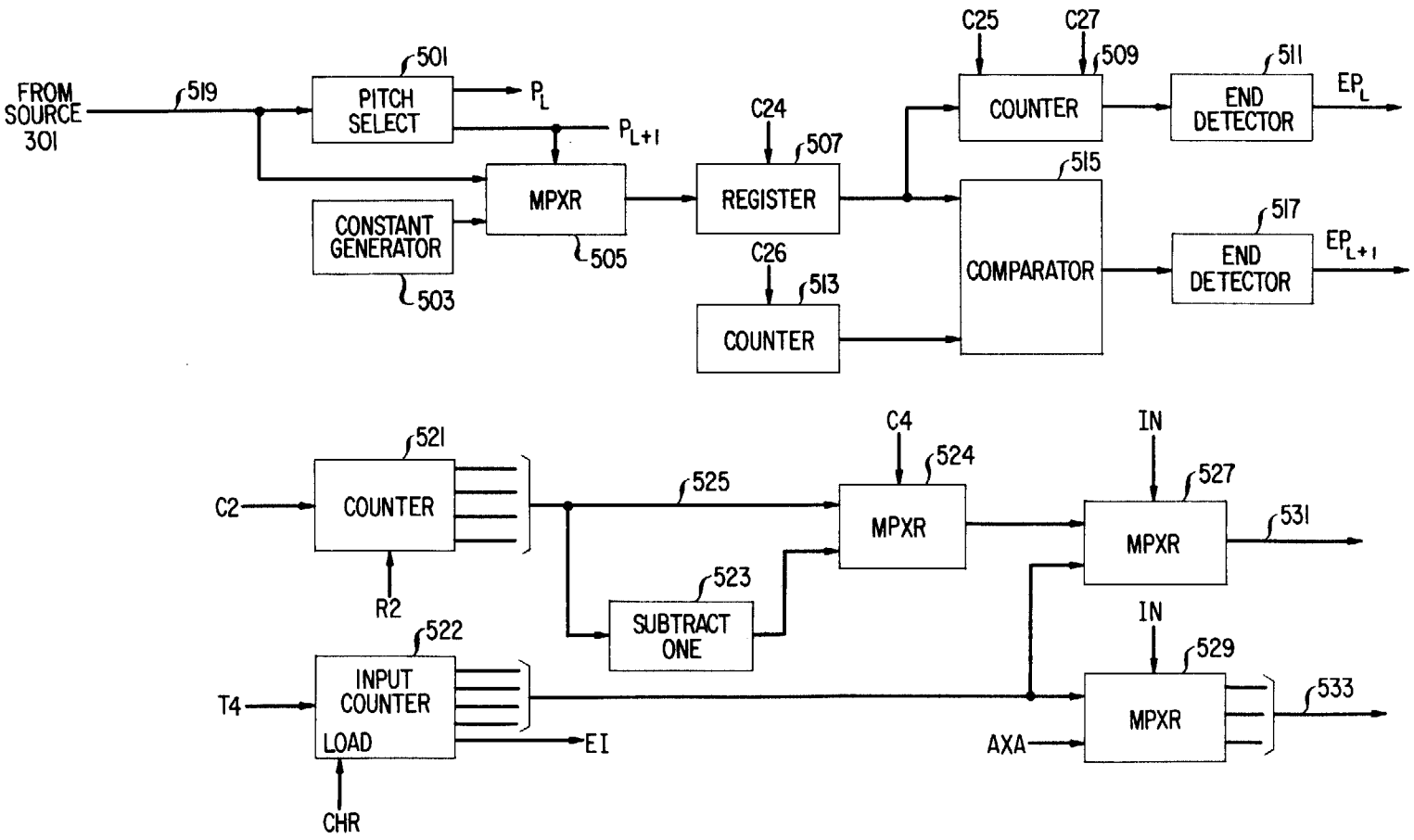

The clocking and control circuitry of control circuit 190 of the speech synthesizer shown in FIG. 1 is depicted in detail in FIGS. 4A, 4B and a portion of FIG. 5. Referring to FIG. 4A, master clock 401, comprising oscillator and pulse circuitry well known in the art, is adapted to provide regularly occurring output pulses at a suitable rate relative to the speech sampling rate. The timing of the clock pulses shown in the timing diagrams of FIGS. 6 through 9 are derived from the master clock. Clock 401, for example, may be operative at an 18 mHz rate for a speech sample rate of 10 kHz. Phase counter 407 operative responsive to the clock pulses from clock 401 comprises a modulo 5 counter, the outputs from which are applied to decoder 409. Decoder 409 produces a repeating sequence of five pulses CT0 through CT4, each of which defines a time period. One sequence of five time periods defines a time slot. The CT4 output of decoder 409 is applied to time slot counter 411 via logic circuit 412. Counter 411 is a modulo 5 counter used during each input mode. The outputs of counter 411 are applied to decoder 413. Decoder 413 produces a repetitive sequence of five time slot defining pulses T0 through T4. These five time slots define an input mode cycle. Counter 415 is a variable modulo counter responsive to the CT4 pulses from decoder 409 to count the number of time slots associated with the other modes of operation. The outputs of counter 415 are decoded in decoder 417 which generates a set of sequentially occurring timing pulses TAo through TAn suitable for defining time slots within each mode other than the input mode.

Mode counter 424 in FIG. 4B is responsive to input pulses from control logic 422 and flip-flops 429 and 431 to provide a coded mode signal which defines the operating mode of the speech synthesizer. Code generator 428 is operative to provide a mode terminating time slot code to comparator 433 responsive to the mode signal. A second input is applied to comparator 433 from counter 415 via line 416. Counter 415 is reset at the end of the mode terminating time slot specified by code generator 428 responsive to the state of counter 424. The resetting operation is accomplished via logic 435 which produces a variable modulo counter clear signal VMC operative to clear counter 415 at the start of a new mode. Comparator 433 also causes logic 437 to produce clock signal C27 at the end of each occurring sample mode to signal the termination of said mode. Logic 439 produces clock signal C26 at the end of each $R_n$ cycle of the component mode responsive to the operation of comparator 433 to provide a termination pulse for the component mode portion.

Modulo 8 counter 469 counts the number of C26 clock signals so that at the end of eight such signals, the component mode is terminated and a sample mode is permitted. The output of counter 469 is applied to mode counter 424 via logic circuit 470. Counter 450 and associated logic circuits in FIG. 4A are operative during the first two cycles of the input mode to provide clock signals C23 through C25 for control of the insertion of the pitch duration and $-P_S$ codes.

The outputs of decoders 409, 413, 417, and mode counter 424 are applied to waveform generator 419 which comprises logic circuits well known in the art and produces the clock pulse waveforms used in the speech synthesizer. The pulses from waveform generator 419 are applied to multiplexer 420 which, in turn, produces clock pulses under control of the mode signal from mode counter 424. The clock pulses are distributed from multiplexer 420 to various components of the speech synthesizer shown in FIGS. 3, 4A, 4B, and 5 to control the operation thereof. For example, clock signal C8 is derived from pulses CT2 in the input mode and CT2 and TA1 in the other modes and occurs in all time slots of the input mode and the sample mode. During each component mode, waveform generator 419 is inhibited from producing clock signal C8 in time slot 15. Similarly, during the $\beta$ compute mode, waveform generator 419 is inhibited from producing clock signal C8 during time slot 3. Clock signal C11 is derived from a flip-flop in waveform generator 419 which is set jointly responsive to signal CT0, time slot 2 signal (TA2) from decoder 417 and $\beta$ compute mode signal from mode counter 424. The flip-flop producing clock signal C11 is reset responsive to signal CT0, time slot 3 signal (TA3) from decoder 417, and the $\beta$ compute mode signal from counter 424. In similar manner, other clock signals are produced and distributed via waveform generator 419 and multiplexer 420.

FIG. 5 shows the pitch duration code storing and counting arrangements including register 507, counters 509 and 513, comparator 515 and detectors 511 and 517 as well as addressing arrangements for stores 310A and B, stores 320A, B and C, and auxiliary memory 370. These circuits are described with reference to the operational sequence of the speech synthesizer.

For purposes of illustration, it is assumed that pitch period L-1 has just terminated and the synthesizer of FIGS. 3, 4A, 4B and 5 is operative to start pitch period L during which the speech samples of pitch period L are generated and the excitation level adjustment factor $\beta_{L+1}$ is produced. The DIVCOMP signal from divider 381 is enabled at the end of the $\beta$ compute mode of pitch period L-1. This signal is operative via logic circuit 460 to set flip-flop 462 from which flip-flop signal IN is obtained. Signal IN then sets ready flip-flop 464 and an RDY signal is sent therefrom to source 301 in FIG. 3. Signal source 301 is thereby alerted that the synthesizer is available to receive the first input code to be transferred in pitch period L.

Signal IN is applied to logic circuit 435 in FIG. 4B from which signal VMC is obtained. Signal VMC clears and inhibits counter 415 in FIG. 4A for the duration of the input mode. Counter 411 is used to define the time slots of the input mode. Signal IN is also applied via logic circuit 470 to mode counter 424 which is then placed in the input mode state. Signal IN also resets flip-flops 429 and 431 to disable the pitch period complete outputs from these flip-flops so that mode counter 424 remains in its input mode state.

Responsive to the RDY signal from flip-flop 464, source 301 sends back a CHR signal when the transmission channel between source 301 and the synthesizer of FIGS. 3, 4A, 4B and 5 is available. Source 301 also sends an R load signal and an ICR signal to the synthesizer to indicate that source 301 output register is loaded and that the first descriptive code (pitch period L+1 duration) in the source output register is ready for transfer.

Counter 411 is enabled by logic circuit 412 to count five CT4 pulses from decoder 409, thereby defining the five time slots TS0 through TS4 of each cycle of the input mode. Counter 407 is enabled by enable logic 403 responsive to the ICR signal and causes decoder 409 to provide the CT0 through CT4 pulses to generator 419. Each T4 pulse in the input mode causes inhibit logic 405 to stop counter 407. Inhibit logic 405 is then disabled by the next ICR signal. Signal CHR is applied from source 301 to input counter 522 to initially set the input counter to its fourteenth state at the beginning of the input mode.

Figure 6:
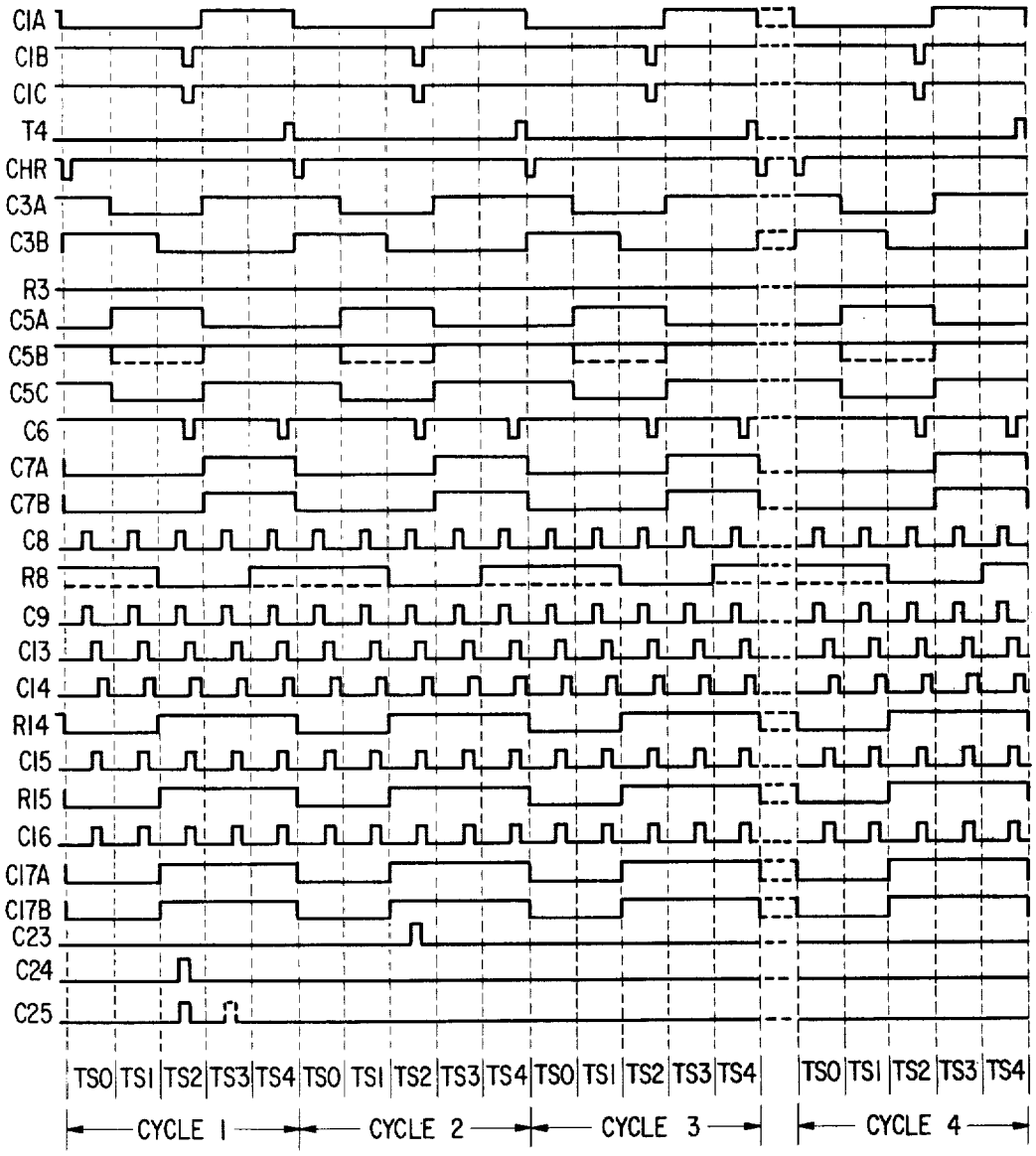
FIGS. 6, 7, 8A, 8B and 9 show timing waveforms useful in describing the operation of the speech synthesizer of FIGS. 3, 4A, 4B, and 5.

Signals ICR and CHR are applied to logic circuit 448 (FIG. 4A) which, in turn, causes counter 450 to provide an enabling signal on lead 451. Responsive to the enabling signal of lead 451 and timing signals CT3 and T2, logic circuit 452 is operative to produce clock signal C24 in time slots TS2 of the first input mode cycle as shown in FIG. 6. Similarly, logic circuit 458 is responsive to the output on lead 451 and the T2 and CT3 signals to produce clock signal C25 in time slot TS2 of the first input mode cycle as shown in FIG. 6. Clock signal C24 is applied to register 507, which stores the pitch period duration code (number of samples $m_{L+1}$) of pitch period L+1, and clock signal C25 is applied to counter 509, so that the pitch period duration code (number of samples $m_L$) of pitch period L from register 507 is transferred to and stored in counter 509.

Referring to FIG. 5, the pitch period duration code of pitch period L+1 is applied from source 301 via lead 519 to pitch select circuit 501 which is operative to distinguish between the pitch code corresponding to a voiced pitch period and the pitch code corresponding to an unvoiced period. Where the pitch period code represents a voiced speech period, multiplexer 505 is set from select circuit 501 to connect line 519 to the input of register 507 so that the pitch period duration code ($m_L+_1$) of pitch period L+1 is inserted into register 507 responsive to clock signal C24. At this time, clock signal C25 is also applied to counter 509 so that the pitch period duration code ($m_L$) of pitch period L originally in register 507 is transferred to pitch period L counter 509. In the event that the pitch period is an unvoiced one, multiplexer 505 connects constant generator 503 to register 507 responsive to the $P_{L+1}$ output of pitch select circuit 501 so that the fixed pitch period code selected for unvoiced pitch periods is entered into register 507 on the occurrence of clock signal C24.

Signal IN is applied to multiplexers 527 and 529 during each cycle of the input mode, whereby the outputs of input counter 522 are operative to successively address the fourteen locations of stores 310A and B and stores 320A, B, and C via multiplexer 527 and to successively address the fourteen locations of the auxiliary memory 370 via multiplexer 529. The application of clock signals 17A and 17B to auxiliary memory 370 causes word 14 of auxiliary memory 37C to be cleared during time slots 0 and 1 of the first cycle. The addressing of stores 310A and B and 320A, B, and C does not affect the operation of the synthesizer during the first cycle of the input mode, since the fourteenth locations of these stores are nonworking locations.

At the end of time slot TS4 of the input mode first cycle, signal T4 from decoder 413 inhibits the operation of counter 407 and resets counter 411 to its zero state. The synthesizer then remains quiescent, until signals R load and ICR are received from source 301 to indicate that the $-P_S$ code of pitch period L+1 is available for transmission to register 340 of FIG. 3. Waveform generator 419 and multiplexer 420 are operative to produce clock signals shown in FIG. 6 during the input mode first and second cycles. Except for clock signals C17A and C17B, clock signals from multiplexer 420 do not affect the operation of the synthesizer.

The next occurrence of signals ICR and R load from source 301 starts the input mode second cycle. Signal ICR is applied to inhibit logic 405 which in turn causes the inhibit signal on counter 407 to be removed. Signal ICR is also applied to logic circuit 412 and to enable logic 403 to permit counters 407 and 411 to operate thereby providing the second cycle clock signals shown in FIG. 6. Signal ICR also sets counter 450 to its second state via logic 448 whereby an enabling signal is placed on lead 453. Logic 454 is operative during time slot TS2 of the second cycle responsive to the enabling signal on lead 453 to produce clock signal C23. This clock signal is applied to store 340 in FIG. 3 so that the $-P_S$ code is inserted therein from source 301. At the end of the first input mode cycle, signal T4 increments counter 522 to its fifteenth state and the outputs of incremented input counter 522 are applied to auxiliary memory 370 via multiplexer 529 responsive to signal IN from flip-flop 462. Clock signals C17*a* and C17*b* enable auxiliary memory 370 during TS0 and TS1 of the second cycle so that a zero code is written into the fifteenth word of auxiliary memory 370. While the fifteenth words of stores 310A and B and 320A, B and C are addressed from counter 522 via multiplexer 527 during the second cycle, changes in these stores do not affect the synthesizer operation. At the end of time slot TS4 of the input mode second cycle, signal T4 activates inhibit logic 405, whereby counter 407 is prevented from counting until the next occurrence of the ICR signal. Counter 411 is inhibited until the next occurrence of the ICR signal by logic circuit 412. Signal T4 also increments input counter 522 to its zero state.

The input mode third cycle is started by the ICR signal from source 301 which indicates that the first linear prediction coefficient code $a_{12}$ of pitch period L+1 is available for transmission from source 301. In the third cycle, the code $R_{-12}=R_{m-11}+\beta_L D_{m-11}$ is formed and stored in yhe zero location of store 320A. The $a_{12}$ code of pitch period L is transferred from store the to store 310B via register 318 and the $a_{12}$ code of pitch period L+1 from source 301 is inserted into the zero location of store 310A. The operation of counter 407 is started responsive to signal ICR being applied from source 301 to inhibit logic 405 and enable logic 403. Counter 522 now addresses the zero words of stores 310A and B and 320A, B and C via multiplexer 527 and line 531. The zero word of auxiliary memory 370 is also addressed via multiplexer 529 and line 533. Responsive to clock signals C17A and C17B in TS0 and TS1 of the third cycle, the zero word of memory 370 is cleared to zero.

In time slot TS0 of the third cycle, the low clock signals C7A and C7B cause multiplexer 315 of FIG. 3 to connect line 322 to register 321. Low clock signal C5A enables store 320A so that $R_{m-11}$ in the zero location of this store is read out onto line 322. During the third period of time slot TS0, clock signal C8 is applied to register 321, whereby $R_{m-11}$ from line 322 is inserted into register 321. The states of clock signals 3A(high), 3B(high) and R3(low) are such that multiplexer 313 connects constant generator 312 to register 318, whereby the constant code 1.0 from generator 312 is applied to register 318. Clock signal C9 permits the insertion of the 1.0 code into register 318 during the third period of time slot TS0. After code 1.0 is in register 318 and the code corresponding to $R_{m-11}$ is in register 321, clock signal C16 opens the inputs of array multiplier 325 during the fourth period of time slot TS0. The contents of registers 318 and 321 are thereby transferred to the inputs of array multiplier 325.

At the beginning of time slot TS1 of the input mode third cycle, clock signal C3A becomes low, while clock signals C3B and R3 remain unchanged whereby multiplexer 313 is operative to connect the output $\beta$C from $\beta$ store 335 to the input of register 318. Clock signal C5A is switched high, while clock signal C5C goes low so that the $D_{m-11}$ code in the zero location of store 320C is read out onto line 322. Multiplexer 315 connects line 322 to the input of register 321, since clock signals C7A and C7B remain unchanged. Responsive to clock signal C8 in the third period of TS1, the $D_{m-11}$ code from store 320C is inserted in register 321. At this time, clock signal C9 is activated and the $\beta_L$ code from output $\beta$C of store 335 is inserted in register 318 via multiplexer 313.

During the fourth period of time slot TS1, the inputs of array multiplier 325 are opened by clock signal C16 and the $\beta_L$ code from register 318 as well as the $D_{m-11}$ code from register 321 are inserted into multiplier 325. The product code $1.0 \times R_{m-11}$ is now available at the output of array multiplier 325. Responsive to low level clock signals C12A, C12B and R12, multilexer 331 connects the output of multiplier 325 to the input of register 337. Multiplexer 333, responsive to low level clock signals C10A, C10B and R10, connects the output of multiplier 325 to the input of register 339. Low clock signal R14 is applied to register 337 whereby register 337 is cleared to zero independent of the output of multiplier 325. The $1.0 \times R_{m-11}$ code from multiplier 325, however, is inserted into register 339 responsive to clock signal C13. Since the outputs of registers 337 and 339 are directly connected to adder 345, adder 345 is operative to form the sum code $1.0 \times R_{m-11}+0$.

Time slot TS2 of the third cycle is now started. In time slot TS2, TS2, 313 connects line 314 to the input of register 318 responsive to low C3A, C3B, and R3 clock signals. During period 3 of time slot TS2, clock signal C9 opens the input of register 318, whereby the $a_{12}$ code of pitch period L in the zero location of store 310A is transferred therefrom to register 318. In the fourth period of this time slot, the $a_{12}$ code of pitch period L+1 is transferred from source 301 to store 310A responsive to low clock pulse C1B. At this time, the $a_{12}$ code of pitch period L is also transferred from register 318 via line 319 to the zero location of store 310B responsive to low clock signals C1B and C1C.

Clock signal C6 is applied to stores 320A, B and C during the fourth period of time slot TS 2. Responsive to clock signal C5C being in its low state, the zero location of store 320C is cleared to zero. During this fourth period, clock signal C14 is high and the $1.0 \times R_{m-11}+0$ sum code from adder 345 is inserted into register 337 via line 332 and multiplexer 331 responsive to low clock signals C12A, C12B, and R12 applied to multiplexer 331.

In the fourth period of time slot TS2, the $\beta_L D_{m-11}$ code is available at the output of multiplier 325, and is transferred to the input of register 339 via multiplexer 333. Responsive to clock signal C13, the $\beta_L D_{m-11}$ code is inserted into register 339. The outputs of registers 337 and 339 are directly connected to the inputs of adder 345, and the sum of the contents of registers 337 and 339 are formed.

At the beginning of time slot TS3 of the third cycle, clock signals C1A, C1B, and C1C are set high to inhibit the operation of stores 310A and 310B during the remainder of the cycle. Multiplexer 315 is set by clock signals C7A and C7B to connect the output of register 348 to the input of register 321. The sum code $R_{m-11} + \beta_L D_{m-11}$ now available at the output of adder 345 is inserted into register 348 upon the occurrence of clock signal C15. Low clock signal R8, however, clears register 321 so that this register is set to zero. During time slot TS4, the R8 clear signal on register 321 is removed and clock signal C8 permits the transfer of the $R_{m-11} + \beta_L D_{m-11}$ code from register 348 to register 321. Clock signal C5A is low so that the zero location of store 320A is addressed and writing into this location is enabled responsive to low clock signal C6. The output of register 321 is thereby inserted into the zero location of store 320A. At the end of time slot TS4 of cycle 3, the T4 pulse from decoder 413 is applied to counter 522 which is thereby incremented to its one state. At the termination of the T4 pulse from decoder 413, inhibit logic 403 is operative to prevent counter 407 from functioning. Counter 411 is inhibited in the absence of an ICR pulse from source 301 whereby the synthesizer is rendered quiescent.

The operation of the synthesizer in cycles 4 through 11 of the input mode is substantially similar to that described with respect to cycle 3. Incremented counter 522 causes the addressing of stores 310A and B, stores 320A, B, and C and auxiliary memory 370 to be changed for each cycle. For example, during cycle 4, input counter 522 is set to its one state so that the $a_{11}$ code of pitch period L is transferred from location 1 of store 310A to location 1 of store 310B, and the $a_{11}$ code of pitch period L + 1 is transferred from source 301 to location 1 of store 310A. The sum code $R_{m-10} + \beta_L D_{m-10}$ is formed and stored in location 1 of store 320A, and locations 1 of store 320C and auxiliary memory 370 are cleared. In input mode cycle 14, counter 522 is placed in its eleventh state, whereby the $a_1$ code of pitch period L is transferred from location 11 of store 310A to location 11 of store 310B, and the $a_1$ code of pitch period L + 1 is transferred from source 301 to location 11 of store 310A. The sum $R_m + \beta_L D_m$ from the output of adder 345 is stored in location 11 of store 320A, while locations 11 of both store 320C and auxiliary memory 370 are cleared.

At the end of the input mode, stores 310A and B contain linear prediction coefficients $a_1,\ldots,a_{12}$ of pitch period L + 1 and pitch period L, respectively. Store 320A contains the $R_{118\ 1},\ldots,R_{-12}$ codes. Store 320B contains the $s_m,\ldots,s_{m-11}$ codes; and store 320C as well as auxiliary memory 370 are cleared to zero. Store 335 contains the $\beta_L$ code generated during the $\beta$ compute mode of pitch period L − 1. Store 340 contains the $-P_S$ code of pitch period L + 1. Register 507 contains a code $m_{l+1}$ corresponding to the number of samples in pitch period L + 1, and counter 509 contains a code $m_L$ corresponding to the number of samples in pitch period L. The termination of the T4 signal from decoder 413 at the end of input mode cycle 14 changes the state of inhibit logic circuit 405, whereby counter 407 is inhibited. The input mode of pitch period L is now completed. Signal EI from counter 522 (FIG. 5) occurs when counter 522 is in its fourteenth state so that control logic 445 is inhibited during the input mode. In this manner, pulses from sample clock 443 are prevented from enabling counter 407 in the input mode.

In the initial pitch period, there is no excitation level adjustment signal to account for overhang energy, and the initial R components of the speech signal are zero. An initiate bit is included in the pitch period duration code transferred from source 301 to pitch period L + 1 register 507 during time slot TS2 of the input mode first cycle. This initiate bit is applied to logic 455 of FIG. 4A which, in turn, generates an INIT signal so that an additional clock signal C25 is produced in time slot TS3 of the initial input mode first cycle. Responsive to this second clock signal C25, the pitch period duration code of the second pitch period from register 507 is transferred to counter 509 and stored therein as the initial pitch period duration code. Since the overhang energy adjustment factor of the first pitch period is zero, the INIT bit is applied to $\beta$ store 335 in FIG. 3 to reset that store to zero.

The initial R component codes in the first pitch period are zero and all locations of store 320A must be cleared in the input mode of pitch period 1. This is accomplished by applying signal INIT to waveform generator 419 for the duration of the first pitch period input mode. Responsive to the INIT signal, multiplexer 420 supplies clock signal R8 during time slots TS0 and TS1 of each cycle of the input mode as indicated by the dotted waveform R8 in FIG. 6. Clock signal R8 clears register 321 to zero in the third through fourteenth cycles so that each R component is set to zero. $\beta_1$ is initially set to zero by the INIT signal so that the sum code $R + \beta D$ transferred to store 320A is zero in each cycle. In this manner all locations of store 320A are set to zero. Additionally, clock signal C5B is enabled in time slots TS1 and TS2 of all cycles of pitch period 1, as indicated by the dotted line on waveform C5B in FIG. 6. Since register 321 was cleared by clock signal R8 in time slot 2, the zero code therefrom is inserted as both the speech samples in store 320B and as the D component in store 320C.

Figure 7:
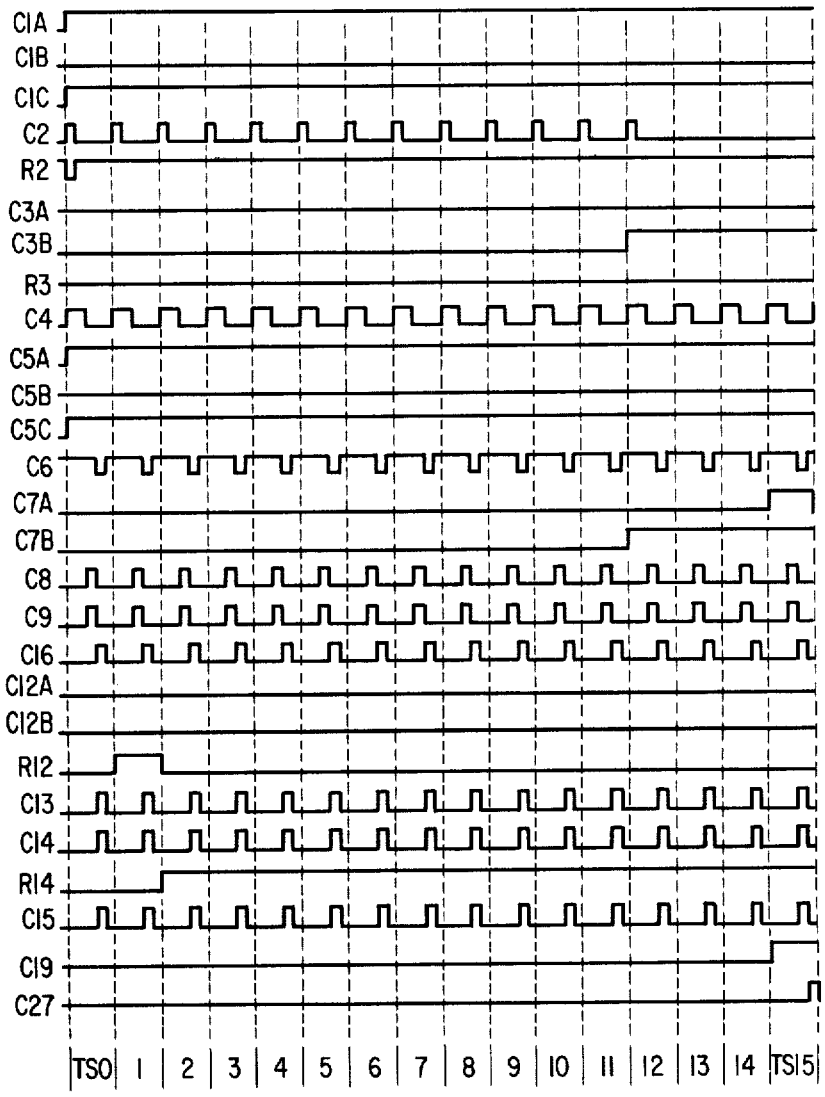

The inhibition of counter 407 at the end of the input mode by signal T4 renders the synthesizer quiescent. Counter 411 remains inhibited in the absence of an ICR signal from source 301. The synthesizer remains quiescent until the occurrence of the next sample clock signal SC from sample clock 443 and control logic 445 in FIG. 4A. This SC signal resets flip-flop 462 so that signal ON is removed, and logic 435 in FIG. 4B is now operative to remove the VMC inhibition on counter 415. The sample mode clock signals are now generated in waveform generator 419 and multiplexer 420, as shown in FIG. 7. Code generator 428 in FIG. 4B has previously been set to 15 responsive to the output of mode counter 424 in the input mode. Comparator 433 now operates to compare the output of counter 415 on line 416 with the output of generator 428 so that the sample mode will be terminated at the end of the fifteenth time slot subsequent to the occurrence of clock signal SC.

The synthesizer of FIGS. 3, 4A, 4B and 5 is operative in each sample mode to generate a speech sample equivalent to $$s_n = \sum_{i=1}^{12} a_i s_{n-i} + \beta_L E_n \quad 1 \leq n \leq m_L,$$

where $m_L$ is the number of speech samples in pitch period L. In the first sample mode, speech sample $s_1$ is generated on the basis of the last twelve speech samples of pitch period 1 − stored in store 320B. In general, speech sample $s_n$ is generated on the basis of $s_{n-1},\ldots,s_{n-12}$ of pitch period L. The sample mode operation is started responsive to signal SC from sample clock 443 which enables counter 407 via control logic 445. Counter 407 operates responsive to the master clock signal from master clock 401 and provides timing signals CT0 through CT4 on the outputs of decoder 409. Counter 415 is responsive to each CT4 signal from decoder 409 to count the time slots in the sample mode. Responsive to the operation of decoders 409 and 417, as well as the MODE signal from counter 424, waveform generator 419 and clock multiplexer 420 provide the clock signals shown in FIG. 7.

Store 310B is operative during the sample mode to provide the linear prediction coefficients $a_1$ through $a_{12}$ of pitch period L used in the generation of the speech sample signals. Store 320B is used to provide the prescribed set of previously obtained speech samples. The speech samples are stored and read out in reverse order, i.e., $s_{n-12},\ldots,s_{n-1}$ as are the prediction coefficients. In the first sample mode of pitch period L, store 320B contains the last twelve samples of pitch period L − 1, which are designated $s_{-1},\ldots,s_{-12}$ in locations 0 through 11. Counter 521 generates the address code to address the desired locations of stores 310B and 320B. In time slot TSO, counter 521 in FIG. 5 is reset to its zero state by clock signal R2, and the zero address code therefrom is applied via multiplexers 524 and 527 and address line 531 to stores 310B and 320B. In each subsequent time slot, clock signal C2 from multiplexer 420 in FIG. 4A increments counter 521 by one. In this manner, successive locations of stores 310B and 320B are addressed.

In the sample mode, signal IN is removed from multiplexer 527 so that this multiplexer is operative to connect the output of multiplexer 524 to the address line 531 of stores 310B and 320B. Clock signal C4 is applied from flip-flop 466 to multiplexer 524 during the first two periods of each sample mode time slot. Responsive to clock signal C4, the address outputs of counter 521 are directly connected to multiplexer 527 via line 525. In the remaining portion of each time slot, clock signal C4 is removed so that subtract one circuit 523 is connected between counter 521 and multiplexer 524. Subtract one circuit 523 decrements the address output of counter 521 by one, whereby the address for registers 310B and 320B is reduced by one. This is done so that the speech sample obtained during the beginning of the time slot is returned to the preceding location responsive to clock signal C6 for use in the next sample mode. The result is a shifting of the set of preceding speech samples, whereby only the next preceding twelve speech samples are utilized for the generation of a new speech sample.

As shown in FIG. 7, clock signal R2 resets counter 521 to zero during the first period of time slot TSO. The zero address of counter 521 is applied to stores 310B and 320B via multiplexers 524 and 527 and line 531. Responsive to low clock signal C1B, linear prediction coefficient $a_{12}$ of pitch period L in location zero of store 310B is read out onto line 314. Clock signal C5B is low so that the $s_{-12}$ code is read out of store 320B onto line 322. Line 314 is connected through multiplexer 313 to the input of register 318 responsive to low clock signals C3A, C3B, and R3. When clock signal C9 is applied to register 318, the $a_{12}$ code is inserted therein. Similarly, line 322 is connected to the input of register 321 via multiplexer 315 responsive to low clock signals C7A and C7B. Upon the occurrence of clock signal C8, the $s_{-12}$ code from line 322 is entered into register 321. The outputs of registers 318 and 321 are connected to the inputs of multiplier 325 so that $a_{12}$ code from register 318 and the $s_{-12}$ code from register 321 are placed in the multiplier responsive to clock signal C16. At this time, subtract one circuit 523 is made operative via multiplexer 524 to decrement the address code for register 320B to 15 responsive to clock signal C4 from flip-flop 466 (FIG. 4A). In this way, the $s_{-12}$ code from register 321 is entered into location 15 of store 320B. Since location 15 is nonworking, speech sample $s_{-12}$ is discarded.

The clock signal C2 occurring at the beginning of time slot TS1 increments counter 521 by one so that locations 1 of stores 310B and 320B are addressed via line 531. Responsive to low clock signals C1B and C5B, the $a_{11}$ code in location 1 is read out of store 310B onto line 314, and the $s_{-11}$ code is read out of location 1 of store 320B onto line 322. In the third period of time slot TS1, the $a_{11}$ code from line 314 is latched into register 318 responsive to clock signal C9, and the $s_{-11}$ code is inserted into register 321 responsive to clock signal C8. Subsequently, the $s_{-11}$ code is put into location 0 of store 320B responsive to clock signal C6 and the address code for register 320B on line 531 obtained from multiplexer 527. In the fourth time period, the $a_{12}s_{-12}$ product is available at the output of multiplier 325 and this product code is inserted into register 339 via multiplexer 333 responsive to low clock signals C10A, C10B, R10, and clock signal C13. As indicated in FIG. 7, high clock signal R12 applied to multiplexer 331 disconnects the output of multiplier 325 from register 337, and register 337 does not receive the output of multiplier 325. Clock signal R14 is applied to register 337 and is operative to clear the register to its zero state.

At the start of time slot TS2, clock signal C2 increments counter 521 so that locations 2 of stores 310B and 320B are addressed during the first and second periods. During the third period of time slot TS2, the $a_{10}$ code read out of store 310A is inserted into register 318 responsive to clock signal C9. Speech sample $s_{-10}$ is also read out of location 2 of store 320B and inserted therefrom into register 321 upon the occurrence of clock signal C8. When clock signal C16 is applied to multiplier 325, the $a_{10}$ code from register 318 and the $s_{-10}$ code from register 321 are applied to the inputs of multiplier 325. The product code $a_{11}s_{-11}$ is now available at the output of array multiplier 325 and this product code is inserted into register 339 via multiplexer 333 responsive to the low level clock signals C10A, C10B, R10, and the occurrence of clock signal C13. During time slot TS2, low clock signals C12A, C12B, and R12 are operative to provide a connection from the output of adder 345 to the input of register 337 through line 332 and multiplexer 331. The product code from multiplier 325 is excluded from register 337. The code corresponding to the partial sum $a_{12}s_{-12}+0$ is now available at the output of adder 345. Upon the occurrence of clock signal C14, the partial sum code is transferred from adder 345 to register 337 via line 332 and multiplexer 331. The partial sum code from register 337 and the product code $a_{11}s_{-11}$ in register 339 are then applied to the inputs of adder 345.

At the end of time slot TS2, the partial sum $a_{12}s_{-12}+0$ has been formed and temporarily stored in register 337 and the partial sum $a_{12}s_{-12}+a_{11}s_{-11}$ is being formed in adder 345. In each of time slots 3 through 11, the partial sum accumulation described with respect to time slot TS2 continues. At the beginning of each of these time slots, counter 521 is incremented to address stores 310B and 320B to obtain the components of the product to be formed. These components are transferred to registers 318 and 321 and therefrom to the inputs of multiplier 325. The just-formed product from multiplier 325 is inserted into register 339 and is added to the accumulated sum in register 337 which is obtained from adder 345. Thus, at the end of time slot TS11 the product code $a_2s_{-2}$ has been inserted in register 339 and the code $$\sum_{i=1}^{9} a_{13-i}\, s_{-13+i}$$

has been inserted in register 337. $a_1$ is in register 318 and $s_{-1}$ is in register 321 and the product code $a_1s_{-1}$ is being formed in multiplier 325. Speech sample code $s_{-1}$ has also been returned to location 10 of store 320B so that it may be used as speech sample $s_{-2}$ in the next sample mode and the partial sum $$\sum_{i=1}^{10} a_{13-i}\, s_{-13+i}$$

is being formed in adder 345.

At the beginning of time slot TS12, clock signal 3B is modified so that multiplexer 313 connects output $\beta C$ of $\beta$ store 335 to register 318, and clock signal 7B is also modified whereby multiplexer 315 connects output EXCIT of excitation generator 330 to the input of register 321. Responsive to the $P_L$ output of select logic 501 in FIG. 5, excitation generator 330 is operative to supply a coded excitation signal to register 321. Where pitch period L is a voiced pitch period, the excitation code E corresponds to a constant code 1.0 in the first sample mode of pitch period L. Where pitch period L is unvoiced, excitation signal $E_n$ is a random number code in each sample of pitch period L, so that the random sample code is applied as the excitation signal to register 321.

Select logic 501 determines and stores coded bit $P_L$ indicating the voiced or unvoiced character of pitch period L. If pitch period L is a voiced pitch period, a high $P_L$ signal applied to excitation generator 330 results in a 1.0 constant code from this generator in time slot TS12 of the first sample mode. A low $P_L$ signal from select circuit 501 activates a random noise source in generator 330 so that a random number code is produced therein in each sample mode.

The excitation code $E_n$ from generator 330 is inserted into register 321 responsive to clock signal C8 in time slot TS12. At this time the $\beta_L$ code from store 335 is latched into register 318 responsive to clock signal C9. The input gates of multiplier 325 are then opened upon the occurrence of clock signal C16, and the $\beta_L$ and $E_n$ codes are placed in the multiplier. The $a_1s_{-1}$ code now available at the output of multiplier 325 is placed into register 339 responsive to clock signal C13. When the sum code $$\sum_{i=1}^{11} a_{13-i}\, s_{-13+i}$$

becomes available at the output of adder 345 in time slot TS12, it is transferred to register 337 on the occurrence of clock signal C14. Adder 345 is then operative responsive to the contents of registers 337 and 339 to start forming the sum code $$\sum_{i=1}^{12} a_{13-i}\, s_{-13+i}.$$

In the third period of time slot TS13, the $\beta_L$ E product code is available at the output of multiplier 325 and is inserted therefrom into register 339 via multiplexer 333. The completed sum $$\sum_{i=1}^{12} a_{13-i}\, s_{-13+i}$$

appears at the output of adder 345 and this sum is transferred to register 337 under control of clock signal C14. The outputs of registers 337 and 339 are then applied to adder 345 and $$s_1 = \sum_{i=1}^{12} a_{13-i}\, s_{-13+i} + \beta_L E_1,$$

the first speech sample of pitch period L is formed in adder 345. Speech sample $s_1$ is available at the output of adder 345 in time slot TS14 and is latched into register 348 responsive to clock signal C15. In time slot TS15, the $s_1$ code is transferred t. output register 360 and also to register 321 via line 352 responsive to high clock signals C7A, C7B and C8. Clock signal C2 is inhibited by the output of counter 415 after time slot TS12 so that the $s_1$ code is inserted into location 11 of store 320B as the $s_{-1}$ code upon the occurrence of clock signal C6.

During the sample mode, code generator 428 (FIG. 4B) applies a coded 15 signal to comparator 433. In time slot TS15, the output of time slot counter 415 matches the coded signal from generator 428. Comparator 433 then produces an output signal which causes logic circuit 435 to generate a VMC signal that is operative to reset counter 415 in FIG. 4A to its zero state. Responsive to the signal from comparator 433, logic circuit 437 produces a C27 clock signal that is applied to decrement counter 509 which keeps track of the number of samples remaining in pitch period L. Upon the occurrence of clock signal C27 in time slot TS15 of the sample mode, inhibit logic 405 is operative to reset counter 407. The TAO signal from decoder 417 occurring when counter 415 is reset enables counter 407 via enable logic 403. The output signal from comparator 433 also steps mode counter 424 via logic circuit 422 so that it is placed in the first D cycle of the component mode.

Figures 8A, 8C:
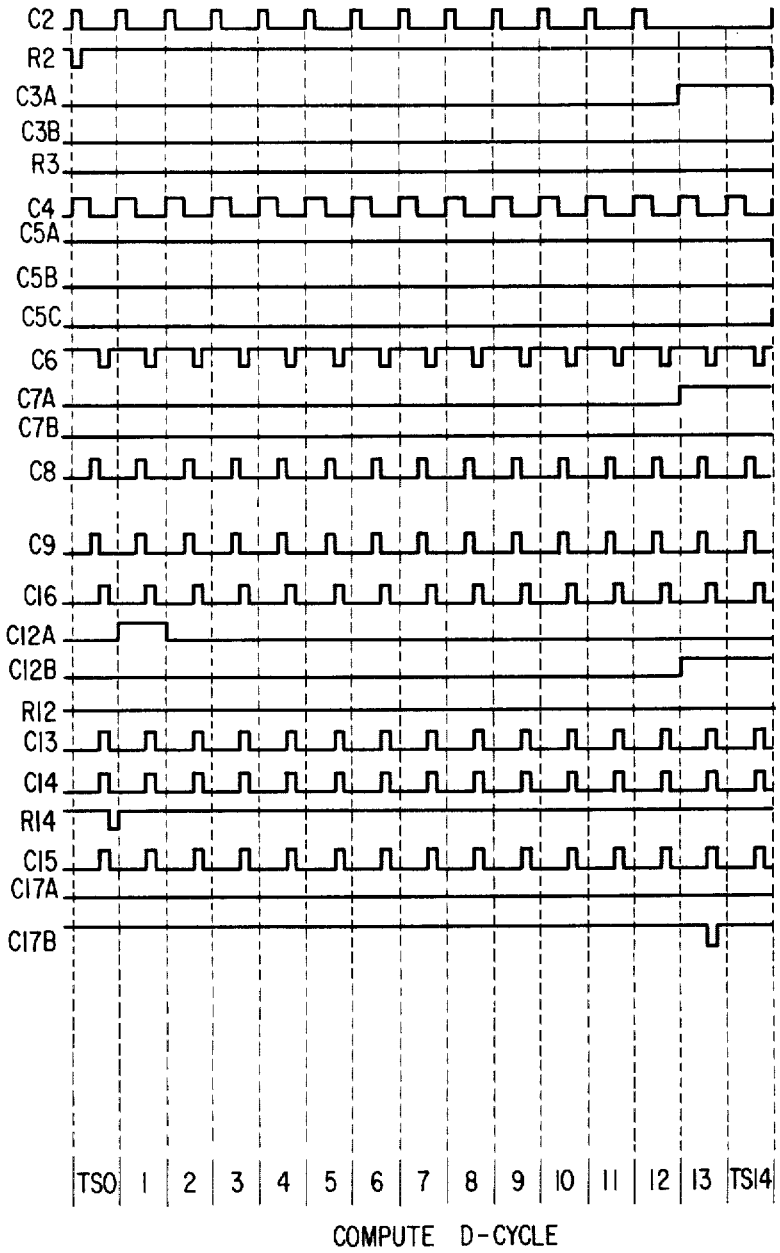
FIG. 8C shows the arrangement of FIGS. 8A and 8B.
Figure 8B:
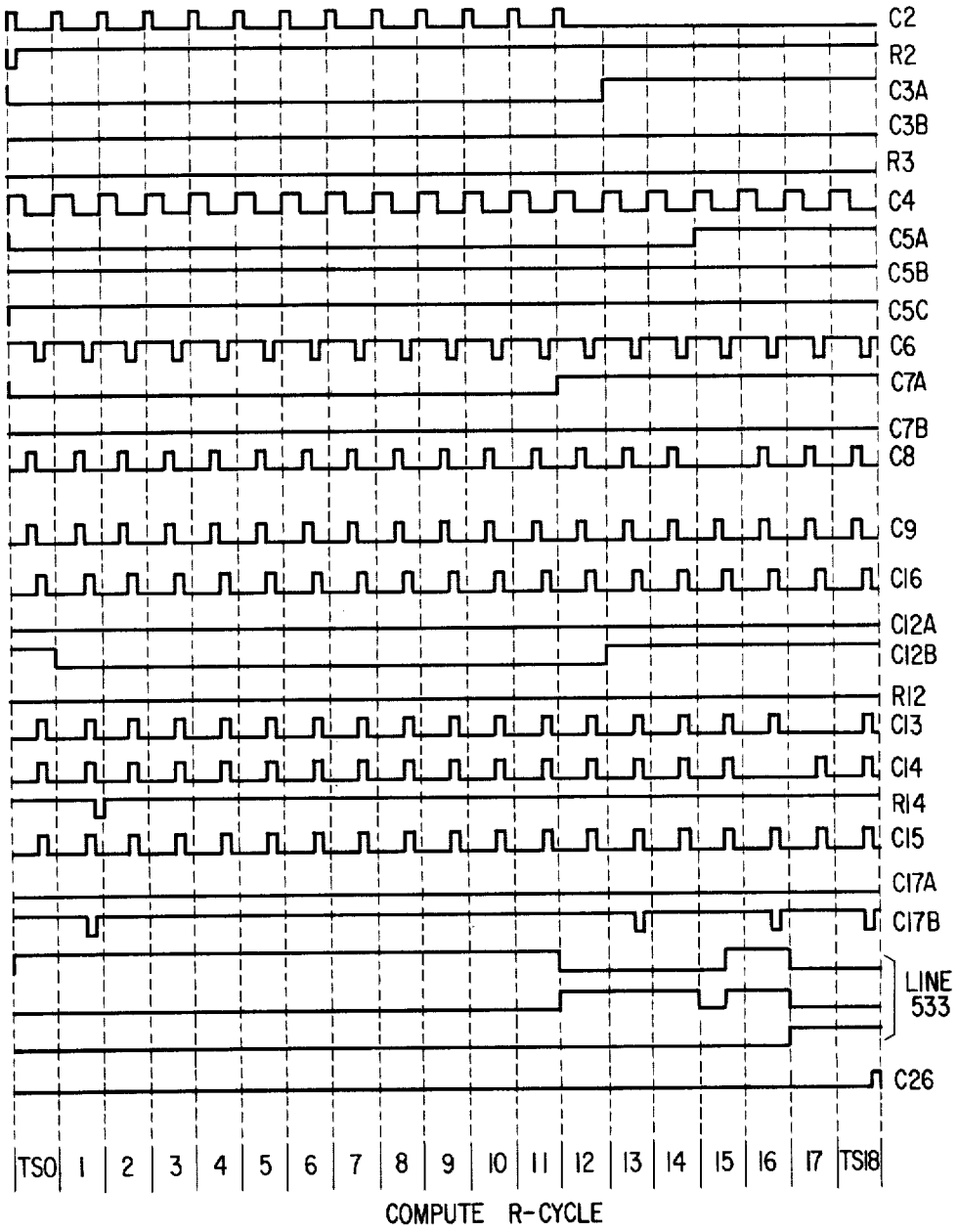

In the D cycle of the first portion of the component mode, the clock signal waveforms shown in FIG. 8A are generated so that the $D_n$ code is produced preparatory to the formation of the $\beta_{L+1}$ code to be used in pitch period L + 1. The $D_n$ code is temporarily stored in location zero of auxiliary memory 370. During each $D_n$ mode, the $D_{n-12},\ldots,D_{n-1}$ codes stored in store 320C are used to compute $D_1$ in accordance with $$\sum_{i=1}^{12} a_{13-i} D_{n-13+i} + E_n.$$

At the beginning of time slot TSO of the D cycle, clock signal R2 is obtained from waveform generator 419 via multiplexer 420 to clear counter 521 to its zero state. As aforementioned with respect to the sample mode, the outputs of counter 521 are applied via multiplexers 524 and 527 and line 531 to address the locations of stores 310A and B, and stores 320A, B, and C. In the first two periods of each time slot, clock signal C4 from flip-flop 466 in FIG. 4A causes multiplexer 524 to apply the outputs of counter 521 to stores 310A and 320C. During the remaining periods of these time slots, the outputs of counter 521 are applied via subtract one circuit 523 so that the address codes for stores 310A and 320C are decremented by one.

Responsive to the address codes from multiplexer 527 and the low C1A clock in time slot TSO, the $a_{12}$ linear prediction coefficient code of pitch period L+1 is read out of location 0 of store 310A onto line 314. At this time, low clock signal C5C is applied to store 320C so that the $D_{n-12}$ code is read out of location 0 and applied to line 322. Multiplexer 313 connects line 314 to the input of register 318, and multiplexer 315 connects line 322 to the input of register 321. When clock signals C8 and C9 occur in the third period of time slot TSO, the $a_{12}$ code is inserted in register 318, and the $D_{n-12}$ code is inserted into register 321. In the succeeding period of time slot TSO, clock signal C16 is applied to multiplier 325, whereby the contents of registers 318 and 321 are transferred to multiplier 325. Clock signal C6 occurs during the fourth period of time slot TSO and is operative to transfer the $D_{n-12}$ code from register 321 into location 15 (nonworking) so that this code is discarded. Low clock signal R14 is applied to register 337 to reset this register to zero.

At the start of time slot TS1, counter 521 is incremented by clock signal C2 so that the $a_{11}$ code from location 1 of store 310A is transferred to register 318, and the $D_{n-11}$ code from location 1 of store 320C is transferred to register 321. The product code $a_{12}D_{n-12}$ is available at the output of multiplier 325 and is transferred into register 339 via multiplexer 333. At this time, multiplexer 331 connects excitation generator 330 to the input of register 337 responsive to the $P_{L+1}$ signal from select logic 501. Excitation generator 330 produces an excitation signal which is inserted into register 337. If pitch period L+1 is a voiced pitch period, signal $P_{L+1}$ is high, and a 1.0 constant code is obtained from generator 330. During the succeeding component modes, no excitation signal will be applied from generator 330. Where pitch period L+1 is unvoiced, a low $P_{L+1}$ signal is applied to generator 330 which activates a noise source therein so that a random number code is inserted during each D cycle into register 337. The outputs of registers 337 and 339 are then applied to the input of adder 345 so that partial sum $a_{12}D_{n-12}+E_n$ will be formed in adder 345. The $D_{n-11}$ code from register 321 is put into location zero of store 320C responsive to the decremented address on line 531 and clock signals C5C and C6. Time slot TS1 is then terminated by signal CT4 from counter 407 (FIG. 4A) incrementing counter 415.

Counter 521 is incremented to its two state by clock signal C2 at the start of time slot TS2. The $a_{10}$ code is then read out of location 2 of store 320A while the $D_{n-10}$ code is read out of location 2 of store 320C. The $a_{10}$ code is inserted into register 318 via multiplexer 315 responsive to low clock signals C3A, C3B, R3, and clock signal C9, and the $D_{n-10}$ code is inserted into register 321 via multiplexer 315 responsive to low clock signals C7A, C7B, and clock signal C8. The $a_{10}$ code is applied to one input of multiplier 325 from register 318 while the $D_{n-10}$ code is applied to the other input of multiplier 325 from register 321. These codes are entered into multiplier 325 upon the occurrence of clock signal C16. At this time, the $a_{11}D_{n-11}$ product code is available at the output of multiplier 325 and is transferred therefrom into register 339 via multiplexer 333 responsive to low level clock signals C10A, C10B, and R10 and to the occurrence of clock signal C13.

The partial sum $a_{12}D_{n-12}+E_n$ from adder 345 is clocked into register 337 via multiplexer 331 and line 332 responsive to the low states of clock signals C12A, C12B, and R12 upon the occurrence of clock signal C14. The contents of registers 337 and 339 are now available at the input to adder 345 and the partial sum $$\sum_{i=1}^{2} a_{13-i} D_{n-13+i} + E_n$$

is formed in the adder. The $D_{n-10}$ code in register 321 is returned to location 1 of store 320C responsive to clock signal C6 in time slot TS2 so that it will be used as the $D_{n-11}$ code in the next D cycle of the component mode.

During time slots TS3 through TS12 the sum $$\sum_{i=1}^{12} a_{13-i} D_{n-13+i} + E_n$$

continues to be formed. For example, in time slot TS6 counter 521 is placed in its sixth state so that code $a_6$ is read from location 6 of store 310B into register 318 and code $D_{n-6}$ is read from location 6 of store 320C into register 321. These codes are then transferred to the inputs of multiplier 325 responsive to clock signal C16. The output of multiplier 325 in time slot TS6 is the product code $a_7D_{n-7}$ which is transferred to register 339. Output of adder 345 is the partial sum $$\sum_{i=1}^{6} a_{13-i} D_{n-13+i}$$

which is transferred to register 337 via line 332 and multiplexer 331. The contents of registers 337 and 339 are then applied to the inputs of adder 345, and, responsive to clock signal C6, $D_{n-6}$ code from register 321 is inserted into location 5 of store 320 to be used as code $D_{n-7}$ in the next pitch period.

At the end of time slot TS12, register 339 contains the product code $a_1D_{n-1}$. Register 337 contains the partial sum $$\sum_{i=1}^{11} a_{13-i} D_{n-13+i} + E_n$$

and these codes are applied to the inputs of adder 345. $D_{n-11}, \ldots, D_{n-1}$ codes have been inserted into locations 0 through 10 of store 320C to be used as the $D_{n-12}, \ldots, D_{n-2}$ codes in the next pitch period. During time slot TS13, $$D_n = \sum_{i=1}^{12} a_{13-i} D_{n-13+i} + E_n$$

is available at the output of adder 345 and is transferred therefrom into register 348 responsive to clock signal C15. Auxiliary memory 370 is addressed by the AXA output of auxiliary memory address multiplexer 441 in FIG. 4B via multiplexer 529 in FIG. 5. Multiplexer 441 receives the output of counter 415 and is controlled by the output of mode counter 424, so that during time slot TS13 the zero location of memory 370 is addressed. Responsive to clock signals 17A and 17B, the output of register 348 is inserted into the zero location of auxiliary memory 370.

In time slot TS14, multiplexer 313 connects the AX output of auxiliary memory 370 to the input of register 318 and multiplexer 315 connects the AX output of auxiliary memory 370 to the input of register 321. Responsive to clock signals C8 and C9, the $D_n$ code from location 0 of auxiliary memory 370 is inserted into registers 318 nd 321. The $D_n$ codes from these registers are applied to multiplier 325 wherein the product code $D_n.D_n$ is formed. Additionally, clock signal C6 causes the $D_n$ code from register 321 to be inserted in location 11 of store 320C. Location 11 of store 320C is addressed in time slot TS14 since the C2 clock signals are terminated after time slot TS12.

During time slot TS0 of each D cycle of the component mode, code generator 428 is set by mode counter 424 to provide a coded 14 signal to comparator 433. In time slot TS14 of the D cycle, the output of counter 415 matches the 14 code from generator 428 and comparator 433 produces an output pulse which steps mode counter 424 to the R cycle state of the component mode. The output pulse from comparator 433 also causes logic circuit 435 to generate a VMC pulse which is operative to reset counter 415 to its zero state. The change in mode counter signal and the resetting of counter 415 causes waveform generator 419 and clock multiplexer 420 to provide the clock signals of the R cycle shown in FIG. 8B.

In the R cycle of the component mode $$R_n = \sum_{i=1}^{12} a_{13-i} R_{n-13+i} \quad 1 \leq n \leq m_{L+1}$$

is formed. The $D_n$ and $R_n$ codes are used to generate the component codes of Equations (10*a*), (10*b*), and (10*c*), which component codes are cumulatively stored in auxiliary memory 370. At the start of time slot TSO of the R cycle, clock signal R2 resets counter 521 so that the $R_{n-12}$ code is read from location zero of store 320A responsive to clock signal C5A and the $a_{12}$ code of pitch period L+1 is read from location zero of store 310A responsive to low clock signal C1A. The $a_{12}$ code is transferred to register 318 via multiplexer 313 and the $R_{n-12}$ code is transferred to register 321 via multiplexer 315 when clock pulses C8 and C9 occur. Responsive to clock signal C16, the $a_{12}$ and $R_{n-12}$ codes are latched into multiplier 325. Location 1 of auxiliary memory 370 is addressed in time slot TSO by multiplexers 441 and 529; and responsive to clock signal C17A, the $$\sum_{n=1}^{n-1} D_n^2$$

code from the AX output of auxiliary memory 370 is read. Clock pulses C12A, C12B and R12 cause multiplexer 331 to apply auxiliary memory 370 AX output to register 337. Upon the occurrence of clock signal C14, the $$\sum_{n=1}^{n-1} D_n^2$$

code is latched into register 337. The $D_n^2$ code available at the output of multiplier 325 is now inserted into register 339 via multiplexer 333 so that adder 345 is operative to form $$\sum_{n=1}^{n} D_n^2.$$

The $R_{n-12}$ code in register 321 is returned to nonworking location 15 of store 320A responsive to clock signal C6 so that it is discarded.

In time slot TS1, counter 521 is incremented by clock signal C2 whereby the $a_{11}$ code is transferred from location 1 of store 310A to register 318 via multiplexer 313 and the $R_{n-11}$ code is transferred from location 1 of store 320A to register 321 via multiplexer 315. Clock signal C16 clocks the $a_{11}$ and $R_{n-11}$ codes into multiplier 325. The $a_{12}R_{n-12}$ code at the output of multiplier 325 is inserted into register 339 via multiplexer 333 responsive to the states of clock signals C10A, C10B, and R10 upon the occurrence of clock signal C13. The component code $$\sum_{n=1}^{n} D_n^2$$

available at the output of adder 345 at this time is inserted into location 1 of auxiliary memory 370 via register 348 and line 354 responsive to clock signals C15, C17A, and C17B. Clock signal R14 is applied to register 337 prior to time slot TS2 so that this register is cleared to zero. Responsive to the change in clock signal C4 and clock signal C6, the address for store 310A is decremented and the $R_{n-11}$ code is returned to the zero location of store 320A for use as $R_{n-12}$ in the next R cycle.

In time slot TS2, the $a_{10}$ and $R_{n-10}$ codes from locations 2 of stores 310A and 320A are addressed by incremented counter 521 and are transferred to the inputs of multiplier 325 via registers 318 and 321. The $a_{11}R_{n-11}$ code at the output of multiplier 325 is inserted into register 339 via multiplexer 333 and the $a_{12}R_{n-12}$ code at the output of adder 345 is transferred to register 337 via line 332 and multiplexer 331. Adder 345 is then operative to form the partial sum code $$\sum_{i=1}^{2} a_{13-i} R_{n-13+i}.$$

The $R_{n-10}$ code from register 321 is returned to location one of store 320A responsive to the change in clock signal C4 and clock signal C6 for use as $R_{n-11}$ in the next R cycle.

During time slots TS3 through TS12, partial sums are generated in the circuit of FIG. 3 under control of waveform generator 419 and multiplexer 420 in accordance with the state of counter 521 as described with respect to time slot TS2. At the end of time slot TS12, the code $$R_n = \sum_{i=1}^{12} a_{13-i} R_{n-13+i}$$

is being formed in adder 345. This sum is available at the output of adder 345 in time slot TS13 and is then transferred to register 348 responsive to clock signal C15. Location 2 of auxiliary memory 370 is addressed from the AXA output of multiplexer 441 at this time. Responsive to clock signals C17A and C17B, and just-formed $R_n$ code is inserted into location 2 of the auxiliary memory.

In time slot TS14, the $R_n$ in location 2 of auxiliary memory 370 at output AX is applied to the inputs of registers 318 and 321 via multiplexers 313 and 315, respectively. Responsive to clock signals C8, C9, and C17A, the $R_n$ code is read out of location 2 of memory 370 and inserted into registers 318 and 321. Upon the occurrence of clock signal C16 in time slot TS14, the contents of registers 318 and 321 are put into multiplier 325 which is operative to form the $R_n^2$ code.

Location zero of auxiliary memory 370 is addressed during the first three periods of time slot TS15. Responsive to clock signals C17A and C9, the $D_n$ code from location zero of auxiliary memory 370 is read out and inserted into register 318. Clock signal C8 does not occur in time slot TS15 so that the $R_n$ code previously inserted in register 321 remains unchanged. Responsive to clock signal C16, the $D_n$ and $R_n$ codes from registers 318 and 321 are put into multiplier 325 which is operative to form the $D_nR_n$ code. In the last two periods of time slot TS15, location 3 of auxiliary memory 370 is addressed so that the $$\sum_{n=1}^{n-1} R_n^2$$

code is read out therefrom as output AX responsive to clock signal C17A and inserted into register 337 by clock signal C14. At this time, the $R_n^2$ code from the output of multiplier 325 has been inserted into register 339 via multiplexer 333 responsive to clock signal C13 so that adder 345 is operative to form the $$\sum_{n=1}^{n} R_n^2$$

component code. In time slot TS16, location 3 of auxiliary memory 370 is still addressed and responsive to clock signals C15, C17A, and C17B, the $$\sum_{n=1}^{n} R_n^2$$

component code from adder 345 is written into location 3 of the auxiliary memory via register 348 and line 354. During time slot TS16, the $D_nR_n$ code available at the output of multiplier 325 is latched into register 339 by clock signal C13; and, at the beginning of time slot TS17, location 4 of auxiliary memory 370 is addressed from line 533 responsive to the AXA output of multiplexer 441. Responsive to clock signal C17A, the $$\sum_{n=1}^{n-1} D_nR_n$$

component code is read out of auxiliary memory 370 as the AX output and is inserted into register 337 by clock signal C14. Adder 345 is then operative to form the $$\sum_{n=1}^{n} D_nR_n$$

component code. During time slot TS18, the $$\sum_{n=1}^{n} D_nR_n$$

component code is transferred from the output of adder 345 to register 348 by clock signal C15 and is then inserted into location 4 of auxiliary memory 370 responsive to clock signals C17A and C17B.

Comparator 433 produces an output pulse responsive to a match between the coded 18 signal from generator 428 and the outputs of counter 415 in the eighteenth time slot of the R cycle. This output pulse is supplied to mode counter 424 via logic circuit 422 to decrement counter 424 to its D cycle state. The output pulse from comparator 433 also causes logic circuit 439 to generate clock signal C26, which signal increments counter 469. Counter 469 is operative to count the number of R cycles and to end the component mode upon completion of eight R cycles. Eight D and R cycles are selected for each component mode since the computation of the component codes for eight cycles can be conveniently accomplished between two successive sample modes as determined by sample clock 443. It is to be understood, however, that other than eight cycles can be used in the component mode where the speech sample rate is altered or the logic circuitry speed is different.

Logic circuit 435 is responsive to the output pulse from comparator 433 at the end of each R cycle to produce a VMC signal, which signal resets counter 415 to its zero state. With mode counter 424 in its D cycle state and counters 407 and 415 reset to their zero states, waveform generator 419 and clock multiplexer 420 are operative to produce the clock signals of the D cycle, as shown in FIG. 8A. Clock signal C26 also increments counter 513 at the end of each R cycle. Counter 513 keeps track of the number of R cycles completed thus far in the currently occurring pitch period (L).

Subsequent to the termination of the first R cycle, the D and R cycles are repeated as previously described. At the end of each R cycle, counter 469 in FIG. 4B is incremented by one. Upon the termination of the eighth R cycle after the first speech sample $s_1$ is generated, auxiliary memory 370 contains the component codes $$\sum_{n=1}^{8} D_n^2, \sum_{n=1}^{8} R_n^2 \text{ and } \sum_{n=1}^{8} D_nR_n$$

and counter 469 produces an output pulse which causes logic 470 to set mode counter 424 to the sample mode state. Inhibit logic 403 is rendered operative by signal IX from counter 469 so that counter 407 is stopped. The synthesizer then remains quiescent until the next sample clock pulse SC is generated at the predetermined 10kHz rate by sample clock 443. Responsive to this SC pulse, counter 407 is enabled via control logic 445 and the sample mode clock waveforms shown on FIG. 7 are produced by waveform generator 419 and clock multiplexer 420. The sample mode previously described is repeated to generate speech sample $s_2$. At the start of this sample mode, store 320B contains $s_1, s_{-1}, \ldots, s_{-10}$ and the excitation code E is modified so that speech sample $s_2$ sent to output register 360 is available in time slot TS14 in accordance with Equation (1).

At the end of each sample mode, clock signal C27 decrements counter 509 which keeps track of the number of samples yet to be generated during currently occurring pitch period L. Mode counter 424 in FIG. 4B is then set to the first D cycle of the next component mode. During this component mode, the next eight sets of component codes are cumulatively formed and stored in auxiliary memory 370. The synthesizer continues to alternate between sample modes and component modes as indicated in waveforms 203 and 205 of FIG. 2 until the output of counter 513 matches the $m_{L+1}$ pitch period code previously stored in register 507 during the first cycle of the input mode. At this time the output of counter 513 equals the $m_{L+1}$ code in register 507 and component codes $$\sum_{n=1}^{m_{L+1}} D_n^2, \sum_{n=1}^{m_{L+1}} R_n^2 \text{ and } \sum_{n=1}^{m_{L+1}} D_n \cdot R_n$$

needed to compute $\beta_{L+1}$ in accordance with Equation (5) are stored in auxiliary memory 370.

Comparator 515 in FIG. 5 is responsive to the match between counter 513 and register 507 to generate an output pulse, which pulse causes end pitch period L+1 detector 517 to generate an $EP_{L+1}$ signal. The $EP_{L+1}$ signal sets flip-flop 431 in FIG. 4B and this flip-flop prevents mode counter 424 from being placed in its component mode state during the remainder of the current pitch period (L). Logic circuit 470 also produces an output pulse responsive to signal $EP_{L+1}$ to set mode counter 424 to its sample mode state. Inhibit logic 405 is now activated by the $EP_{L+1}$ signal and is operative to stop counter 407. The synthesizer is then quiescent and remains so until the next SC pulse is generated by sample clock 443. This next SC pulse enables counter 407 so that the sample mode is repeated. In this manner, speech samples are generated at the rate determined by sample clock 443, e.g., 10 kHz.

Figure 9:
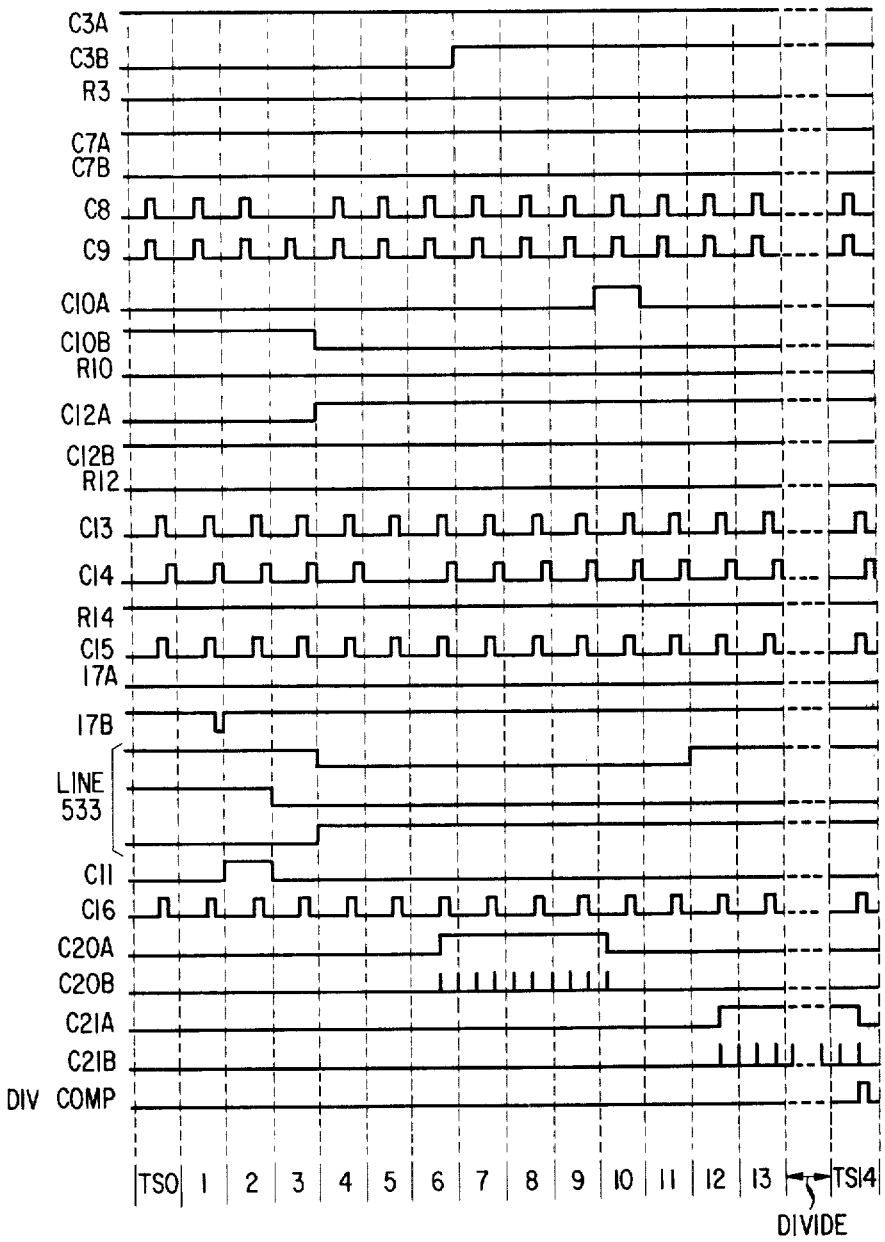

At the end of each sample mode, clock signal C27 from logic circuit 437 decrements pitch period L counter 509. When counter 509 is placed in its zero state, an $EP_L$ signal is generated by detector 511, and flip-flop 429 in FIG. 4B is set. Responsive to the state of flip-flop 429, mode counter 424 is prevented from being set to its sample mode state for the remainder of pitch period L. The $EP_L$ signal also causes logic circuit 470 to produce an output pulse, which pulse sets mode counter 424 to its $\beta_{L+1}$ compute mode state. Responsive to the $\beta_{L+1}$ mode signal from counter 424, logic circuit 425 produces a $\beta$ signal which is operative via mode logic 426 to ensure that counter 469 is reset to its zero state. Counter 415 has been reset to its zero state responsive to the VMC signal from logic 435 in the last sample mode. At this time, enable logic 405 starts counter 407 responsive to the $\beta$ signal from logic circuit 425 and the clock signals of time slot TSO of the $\beta$ mode are generated in waveform generator 419 and clock multiplexer 420, as shown in FIG. 9.

In time slot TSO of the $\beta$ mode, multiplexer 333 connects the output of store 340 to the input of register 339 responsive to low clock signal C10A, high clock signal C10B, and low clock signal R10. Multiplexer 331 is operative to connect the AX output of auxiliary memory 370 to the input of register 337 in accordance with the states of clock signals C12A, C12B, and R12 and the AXA output of multiplexer 441 addresses location 3 of auxiliary memory 370 via multiplexer 529 and line 533. In the third period of time slot TSO, the $-P_S$ code from store 340 is put into register 339 responsive to clock signal C13; and, in the fourth period of this time slot, the $$\sum_{n=1}^{m_{L+1}} R_n^2$$

component code from location 3 of auxiliary memory 370 is latched into register 337 on occurrence of clock signals C17A and C14. Responsive to the $$\sum_{n=1}^{m_{L+1}} R_n^2$$

code from register 337 and the $-P_S$ code from register 339, adder 345 is operative to form the $$Q = \sum_{n=1}^{m_{L+1}} R_n^2 - P_S$$

code of Equation 5.

In time slot TS1, location 3 of auxiliary memory 370 is still addressed by the AXA output of multiplexer 441. The Q code from the output of adder 345 is transferred to register 348 by clock signal C15 and is written into location 3 of auxiliary memory 370 via line 354 upon the occurrence of clock signal C17B. During time slot TS2, multiplexer 315 connects the AX output of auxiliary memory 370 to the input of register 321, and clock signals C17A and C8 cause the Q code from location 3 of memory 370 to be inserted into register 321. Also during time slot TS2, clock signal C11 is applied to sign store 384 so that the sign bit of the Q code is inserted therein. If the sign of the Q code is positive, store 384 applies an inhibit signal to $\beta$ store 335 so that a zero code is inserted therein, and the $\beta_{L+1}$ code is set to zero.

Location 1 of auxiliary memory 370 is addressed in time slot TS3 of the $\beta$ mode, and multiplexer 313 is operative to connect the AX output of auxiliary memory 370 to the input of register 318. Responsive to clock signals C17A and C9 the $$\sum_{n=1}^{m_{L+1}} D_n^2$$

code from location 1 of auxiliary memory 370 is read therefrom and placed into register 318. Clock signal C16 then clocks the Q code from register 321 and the $$\sum_{n=1}^{m_{L+1}} D_n^2$$

code from register 318 into multiplier 325.

The AXA output of multiplexer 441 addresses location 4 of auxiliary memory 370 in time slot TS4, and the $$\sum_{n=1}^{m_{+}1} D_n R_n$$

code from this location is transferred into registers 318 and 321 responsive to clock signals 17A, C9, and C8. The $$\sum_{n=1}^{m_{+}1} D_n R_n$$

codes from registers 318 and 321 are then clocked into multiplier 325 responsive to clock signal C16. Multiplier 325 is now operative to form the $$\left(\sum_{n=1}^{m_{L+1}} D_n R_n\right)^2$$

code. The product code $$\sum_{n=1}^{m_{L+1}} D_n^2 \cdot Q$$

available at the output of multiplier 325 is now placed into register 337 via line 332 multiplexer 331 responsive to clock signal C14. The $$\left(\sum_{n=1}^{m_{L+1}} D_n R_n\right)^2$$

code at the output of multiplier 325 in time slot TS5 is inserted into register 339 via multiplexer 333 by clock signal C13. The outputs of registers 337 and 339 then cause adder 345 to be operative to form the $$V = \left(\sum_{n=1}^{m_L+1} D_n R_n\right)^2 - \sum_{n=1}^{m_L+1} D_n^2 \cdot Q$$

code which is transferred into register 348 in time slot TS6 by clock signal C15.

Clock signal C20A becomes enabling during time slot TS6 so that the V code from adder 345 is transferred therefrom to the input of square root circuit 383. The square root circuit is operative responsive to internally generated clock signal C20B to generate $\sqrt{V}$ during time slots TS6 through TS10. When the $\sqrt{V}$ code is available from circuit 383 in time slot TS10, a COM1 signal is produced by square root circuit 383. The COM1 signal is applied to waveform generator 419 which causes multiplexer 420 to modify clock signal C10A so that the square root output SQR of circuit 383 is connected to the input of register 339 via multiplexer 333 during time slot TS10. In this manner, the square root code $\sqrt{V}$ from circuit 383 is put into register 339 responsive to clock signal C13. In time slot TS10, the $$\sum_{n=1}^{m_{L+1}} D_n \cdot R_n$$

code from location 4 of auxiliary memory 370 as addressed by multiplexer 441 is placed in register 321 via multiplexer 315 responsive to the states of clock signals C7A and C7B by clock signal C8. Multiplexer 313 connects constant generator 312 to register 318 responsive to clock signals C3A, C3B, and R3, and the 1.0 constant code from generator 312 is entered into register 318 by clock pulse C9. In time slot TS10, multiplier 325 is operative to form the $$\left(\sum_{n=1}^{m_{L+1}} D_n \cdot R_n\right)(1.0)$$

code which is inserted into register 337 by clock pulse C14 in time slot TS11. Adder 345 is responsive to the $$\sum_{n=1}^{m_{L+1}} D_n \cdot R_n$$

code from register 337 and the V code from register 339 to form the $$-\sum_{n=1}^{m_{L+1}} D_n \cdot R_n + \sqrt{V}_{code}.$$

In time slot TS12 the $$-\sum_{n=1}^{m_{L+1}} D_n R_n + \sqrt{V}$$

code from the output of adder 345 is transferred to the dividend input of divider 381 responsive to clock signal C21A. Location 1 of auxiliary memory 370 is addressed, and, responsive to clock signals C17A and C21A, the $$\sum_{n=1}^{m_{L+1}} D_n^2$$

code from this location appearing on the AX output of memory 370 is inserted into the divisor input of divider 381. The $\beta_{L+1}$ code is then generated in divider 381 under control of clock signal 21B, which clock signal is generated internally in divider 381. Upon formation of the $\beta_{L+1}$ code in divider 381, the DIVCOMP signal is produced by divider 381 which permits the just-formed $\beta_{L+1}$ code to be latched into store 335. As aforementioned, the DIVCOMP signal indicates the termination of pitch period L and is applied to logic circuit 460 to start the input mode of pitch period L+1.

The synthesizer of FIGS. 3, 4A, 4B and 5 continues to generate speech samples on the basis of parametric description codes from source 301 as aforementioned. When parametric description codes are no longer available from source 301, the CHR signal is disabled so that the synthesizer remains quiescent.

While the invention has been described and shown with reference to particular embodiments thereof, it is to be understood that various changes in form and detail may be made by those skilled in the art without departing from the spirit and scope of the invention.

What is claimed is:

1. A synthesizer for producing a speech signal from segmented parametric description signals, and preceding speech samples of said speech signal comprising means for storing an excitation level adjustment signal for the currently occurring speech segment, means operative in spaced time periods of the currently occurring speech segment responsive to the parametric description signals of said current speech segment, said preceding speech samples, and said excitation level adjustment signal for generating the speech samples of said current speech segment at a predetermined rate; means operative in intervals between said spaced time periods responsive to the parametric description signals of the next successive speech segment and said preceding speech samples for forming signals representative of prescribed component codes of the excitation level adjustment signal of the next successive speech segment; and means operative after termination of the final spaced time period of the current speech segment responsive to said component code signals and said next successive speech segment parametric description signals for producing the excitation level adjustment signal of said next successive speech segment.

2. A synthesizer for producing a speech signal from segmented parametric description signals, and preceding speech samples of said speech signal according to claim 1 wherein parametric description signals are segmented into pitch periods of said speech signal.

3. A snythesizer for producing a speech signal from segmented parametric description signals and preceding speech samples of said speech signal according to claim 2 wherein said parametric description signals include signals representative of pitch period segment prediction parameters, a signal representative of pitch period segment speech energy, and a signal representative of the pitch period segment excitation; said speech sample generating means comprises first means responsive to the current pitch period segment prediction parameter signals, said preceding speech samples, the current pitch period segment excitation signal and the current pitch period segment excitation level adjustment signal for generating said current pitch period speech samples; said component code signal forming means comprises second means jointly responsive to the next successive pitch period segment prediction parameter signals, the next successive pitch period segment excitation signal, and the preceding speech samples for producing said set of prescribed component code signals; and said excitation level adjustment signal producing means comprises means jointly responsive to said set of prescribed component code signals and said next successive pitch period segment energy signal for producing the excitation level adjustment signal of the next successive pitch period segment.

4. A synthesizer for producing a speech signal from pitch period segmented parametric description signals and preceding speech samples of said speech signal according to claim 3 wherein said first means comprises means operative in each spaced time period for arithmetically combining said current pitch period segment prediction parameter signals, said preceding speech samples, said current pitch period segment excitation signal and said current pitch period segment excitation level adjustment signal to form a speech sample of the current pitch period segment.

5. A synthesizer for producing a speech signal from segmented parametric description signals and preceding speech samples of said speech signal according to claim 4 wherein said arithmetically combining means comprises means for multiplying the current pitch period segment excitation signal and said current pitch period segment excitation level adjustment signal to form a first signal; means for arithmetically combining said current pitch period segment prediction parameter signals with a first prescribed set of preceding speech samples to form a second signal; and means for summing said first and second signals to generate said speech sample.

6. A synthesizer for producing a speech signal from segmented parametric description signals and preceding speech samples of said speech signal according to claim 5 wherein said second means comprises means for arithmetically combining said next successive pitch period segment prediction parameter signals, a second prescribed set of preceding speech samples and the next successive pitch period segment excitation signal to form the signals representative of said set of component codes of the next successive pitch period segment excitation level adjustment signal.

7. A snythesizer for producing a speech signal from segmented parametric description signals and preceding speech samples of said speech signal according to claim 6 wherein said third means comprises means for arithmetically combining said component code signals with said next successive pitch period segment energy signal to form the excitation level adjustment signal of the next successive pitch period segment.

8. A synthesizer for producing a prescribed speech signal from concatenated pitch period descriptive parameter codes comprising means for storing first signals representative of predictive parameters of a pitch period speech signal segment, means for storing second signals representative of predictive parameters of the next successive pitch period speech signal segment, means for storing a third signal representative of the energy of said next successive pitch period speech signal segment, means for storing a first set of preceding speech samples, means for storing a second set of preceding speech samples, means for storing an excitation adjustment signal, an excitation signal source, means operative at predetermined spaced time periods responsive to said first signals, said first set of preceding speech samples, the excitation signal of said pitch period from said excitation signal source, and said excitation adjustment signal for generating the speech samples of said pitch period segment, means operative in selected intervals between said spaced time periods responsive to said second signals, said second set of preceding speech samples and the excitation signal of said next successive pitch period from said excitation signal source for forming a plurality of coded signals representative of prescribed components of the next successive pitch period excitation adjustment signal, and means operative after the final spaced time period of said pitch period responsive to said coded signals and said third signal for generating the excitation adjustment signal of said next successive pitch period speech signal.

9. A synthesizer for producing a prescribed speech signal from concatenated pitch period descriptive parameter codes according to claim 8 wherein said speech sample generating means comprises first means operative in each spaced time period for arithmetically combining said first signals, said first set of preceding speech samples, said pitch period excitation signal, and said excitation adjustment signal to produce a speech sample of said pitch period, and said coded signal forming means operative in selected intervals between said spaced time periods comprises second means for arithmetically combining said second signals, said second set of preceding speech samples and said next successive pitch period excitation signal to cumulatively form a plurality of said coded component signals.

10. A synthesizer for producing a prescribed speech signal from concatenated pitch period descriptive parameter codes according to claim 9 wherein said second means is operative to produce one set of component signals from each sample of the next successive pitch period, and further comprising means for storing a signal representative of the number of samples in said next successive pitch period, means for counting the number of operations of said second means, and means responsive to said sample number signal of said storing means being equal to the operation count of said counting means for disabling said second means for the remainder of said pitch period.

11. A synthesizer for producing a prescribed speech signal from concatenated pitch period descriptive parameter codes according to claim 10 further comprising means for storing a signal representative of the number of speech samples of the current pitch period, means for counting the number of speech samples produced by said first means, and means responsive to said number of samples of said current pitch period equaling the counted number of speech samples of said pitch period for disabling said speech sample generating means.

12. Apparatus for synthesizing a speech signal from pitch period segmented linear prediction parameter signals, excitation signals, pitch period speech segment energy signals, and preceding samples of said speech signal comprising means for storing a current pitch period excitation level adjustment signal, first means operative in regularly spaced time periods of the current pitch period responsive to the current pitch period prediction parameter signals, a first group of preceding speech samples, the current pitch period excitation signal, and the current pitch period excitation level adjustment signal for generating speech samples of said current pitch period, second means operative in intervals between said spaced time periods responsive to the next successive pitch period prediction parameter signals, a second group of preceding speech samples and the next successive pitch period excitation signal for forming signals representative of a prescribed set of components of the excitation level adjustment signal of the next successive pitch period, and third means operative upon termination of the final spaced time period of said current pitch period responsive to said next successive pitch period speech energy signal and the prescribed set of component signals for producing the excitation level adjustment signal of the next successive pitch period.

13. A method for synthesizing a speech signal from pitch period segmented parametric description signals, pitch period segmented excitation signals, and preceding speech samples of said speech signal comprising the steps of generating speech samples of the currently occurring pitch period in regularly spaced time periods responsive to the current pitch period parametric description signals, said preceding speech samples and the current pitch period adjusted excitation signal; forming signals representative of a prescribed set of components of the excitation adjustment signal of the next successive pitch period in intervals between said spaced time periods responsive to the parametric description signals of the next successive pitch period, the preceding speech samples, and the excitation signal of the next successive pitch period; and producing the excitation adjustment signal of the next successive pitch period upon termination of the last spaced time period of said current pitch period responsive to the next successive pitch period parametric description signals and said component signals.

14. A method for synthesizing an artificial speech signal from segmented parametric description signals and preceding speech samples of the artificial speech signal comprising the steps of receiving parametric description signals of the currently occurring speech segment, parametric description signals of the next successive speech segment, a signal representative of the energy of the next successive speech segment, and a signal representative of the excitation of the currently occurring and next successive speech segments; storing an excitation level adjustment signal of the currently occurring speech segment; generating speech samples of the current speech signal segment in regularly spaced time periods responsive to the current speech segment parametric description signals, the preceding speech samples, the current speech segment excitation signal, and the current speech segment excitation level adjustment signal; forming signals representative of prescribed components of the next successive speech segment excitation level adjustment signal in intervals between said spaced time periods responsive to the next successive speech segment parametric description signals, the preceding speech samples, and the next successive speech segment excitation signal; and producing the next successive speech segment excitation level adjustment signal upon termination of the final spaced time period responsive to the next successive speech segment energy signal and the formed component signals.

15. A method of synthesizing an artificial speech signal from segmented parametric description signals and preceding speech samples of artificial speech signals according to claim 14 wherein the speech sample generating step comprises arithmetically combining the current speech segment parametric description signals, the preceding speech samples, the current speech segment excitation signal, and the current speech segment excitation level adjustment signal in each of said spaced time periods to generate one speech sample of said current speech segment.

16. A method of synthesizing an artificial speech signal from segmented parametric description signals and preceding speech samples of artificial speech signals according to claim 15 wherein the component signal forming step comprises arithmetically combining the next successive speech segment parametric description signals, the preceding speech samples, and the next successive speech segment excitation signal in selective intervals between said spaced time periods.

17. A method of synthesizing an artificial speech signal from segmented parametric description signals and preceding speech samples of artificial speech signals according to claim 16 wherein the next successive speech segment excitation level adjustment signal producing step comprises arithmetically combining the formed component signals with the next successive speech segment energy signal upon termination of the final spaced time period.

18. A method of synthesizing an artificial speech signal from segmented parametric description signals and preceding speech samples of artificial speech signals according to claim 17 wherein each speech segment comprises a pitch period of said artificial speech signal.

19. A linear prediction synthesizer for producing an artificial speech signal at a real-time pitch period rate comprising means for receiving pitch period segmented predictive parameter signals, pitch period segmented speech signal energy signals, pitch period segmented excitation signals, and signals representative of the number of samples in each pitch period; means for storing first and second groups of preceding samples of said speech signal; means for storing the currently occurring pitch period excitation level adjustment signal; means operative in regularly spaced time periods of the currently occurring pitch period for generating speech samples of said current pitch period comprising first means for arithmetically combining the current pitch period predictive parameter signals with said first group of preceding speech signal samples, means for multiplying the current pitch period excitation signal with the stored excitation level adjustment signal of said current pitch period, means for summing the output of said first means and the output of said second means to form a speech sample of said current pitch period, and means responsive to the current pitch period sample number signal for disabling said speech generating means when the number of speech samples generated equals said current pitch period sample number signal; means operative in selected intervals occurring between said spaced time periods for cumulatively forming a group of signals representative of a set of components of the next successive pitch period excitation level adjustment signal comprising third means for arithmetically combining said second group of preceding speech samples with said next succeeding pitch period predictive parameter signals for each speech sample of the next successive pitch period, fourth means responsive to said arithmetically combined signals from said third means for forming a prescribed set of said next succeeding pitch period excitation level adjustment signal components for each speech sample of said next successive pitch period, means for cumulatively combining each excitation level, adjustment signal component with the corresponding excitation level adjustment signal component formed for the preceding speech samples of said next successive pitch period, a plurality of sets of speech sample excitation level adjustment component signals being formed in each selected interval, and means responsive to the next successive pitch period sample number signal equaling the number of operations of said fourth means for disabling said component signal forming means; and means operative upon the disabling of said sample generating means for producing the next successive pitch period excitation level adjustment signal comprising means for arithmetically combining said formed group of component signals with said next successive pitch period speech energy signal; and means for applying the produced excitation level adjustment signal to said excitation level adjustment signal storing means.

20. A synthesizer for producing an artificial speech signal from pitch period segmented descriptive codes comprising means operating at the beginning of the currently occurring speech signal pitch period for receiving predictive parameter signals of the next succeeding pitch period, a signal representative of the next succeeding pitch period speech energy, a signal representative of the next successive pitch period excitation; means for storing first and second groups of preceding samples of said speech signal; means for storing an excitation adjustment signal for the current pitch period; means operative at regularly spaced times in the currently occurring pitch period for generating the current pitch period speech samples comprising first means for combining the previously received predictive parameter signals of the current pitch period, the first group of preceding samples, the previously received excitation signal of the current pitch period, and the stored excitation adjustment signal of the current pitch period; means operative in intervals between said regularly spaced times for cumulatively forming signals representative of a prescribed set of component codes of the next successive pitch period excitation adjustment signal comprising second means for combining the next successive pitch period predictive parameter signals, the second group of preceding samples and the next successive pitch period excitation signal; and means operative after the final spaced time of the current pitch period for producing the next successive pitch period excitation adjustment signal comprising third means for combining said component code signals with the next succeeding pitch period speech energy signal.

21. A synthesizer for producing an artificial speech signal from pitch period segmented descriptive codes according to claim 20 wherein said first group of samples comprises a first prescribed set of the immediately preceding samples of said speech signal generated by said sample generating means.

22. A synthesizer for producing an artificial speech signal from pitch period segmented descriptive codes according to claim 21 wherein said second group of samples comprises a second prescribed set of immediately preceding outputs produced by said second combining means.

23. A synthesizer for producing an artificial speech signal from pitch period segmented descriptive codes according to claim 22 further comprising means for receiving a first signal corresponding to the number of speech samples of the next succeeding pitch period; means for storing said first signal; means for counting the number of operations of said second combining means; and means responsive to the first signal equaling the counting means number for disabling said component code signal forming means.

24. A synthesizer for producing an artificial speech signal from pitch period segmented descriptive codes according to claim 23 wherein a plurality of component code signal formations occur in each interval until said component code signal forming means is disabled.

25. A synthesizer for producing an artificial speech signal from pitch period segmented descriptive codes according to claim 24 further comprising means for storing a second signal representative of the number of samples of the current pitch period; means for counting the number of samples generated in the current pitch period; and means responsive to said second signal equaling the counted number of generated samples for disabling said sample generating means and for enabling said excitation adjustment signal producing means.

26. An artificial speech synthesizer for producing a speech signal from pitch period segmented parametric description signals comprising means for storing a pitch period speech corrective signal; means operative in regularly spaced time periods of the currently occurring pitch period responsive to the parametric description signals of said current pitch period and said pitch period corrective signal for generating samples of said pitch period speech segment, means operative in intervals between said spaced time periods responsive to the parametric description signals of the next successive pitch period for forming signals representative of a prescribed set of component codes of the speech corrective signal of the next successive pitch period; and means operative upon termination of the last spaced time period responsive to said component code signals for producing the corrective signal of the next successive pitch period.

* * * * *